US010196248B2

(12) United States Patent
Bainter et al.

(10) Patent No.: US 10,196,248 B2
(45) Date of Patent: Feb. 5, 2019

(54) JACK WITH TWO MASTS

(71) Applicant: Bainter Construction Services, LLC, Hoxie, KS (US)

(72) Inventors: Wesley Allen Bainter, Hoxie, KS (US); Jeffrey Daniel Bonnet, Greenwood Village, CO (US); Julius Peter Van de Pas, Greenwood Village, CO (US)

( * ) Notice: Subject to any disclaimer, the term of this patent is extended or adjusted under 35 U.S.C. 154(b) by 0 days.

(21) Appl. No.: 15/664,737

(22) Filed: Jul. 31, 2017

(65) Prior Publication Data

US 2017/0327357 A1 Nov. 16, 2017

Related U.S. Application Data

(63) Continuation-in-part of application No. 14/326,170, filed on Jul. 8, 2014, now Pat. No. 9,718,656.

(60) Provisional application No. 61/843,767, filed on Jul. 8, 2013.

(51) Int. Cl.

| | |
|---|---|
| ***E04H 7/06*** | (2006.01) |
| ***E04H 7/30*** | (2006.01) |
| ***B66F 1/08*** | (2006.01) |
| ***B66F 3/30*** | (2006.01) |
| ***B66F 3/24*** | (2006.01) |
| ***E04H 5/08*** | (2006.01) |
| ***E04B 1/35*** | (2006.01) |
| ***B66F 3/46*** | (2006.01) |

(52) U.S. Cl.

CPC ..... *B66F 3/24* (2013.01); *B66F 1/08* (2013.01); *B66F 3/30* (2013.01); *B66F 3/46* (2013.01); *E04B 1/3522* (2013.01); *E04H 5/08* (2013.01); *E04H 7/06* (2013.01); *E04H 7/30* (2013.01); *Y10T 29/49828* (2015.01)

(58) Field of Classification Search

CPC ..... B66F 1/025; B66F 1/08; B66F 2700/052; B66F 2700/055; B66F 3/46; B66F 3/24; B66F 3/30; E04B 1/3522

See application file for complete search history.

(56) References Cited

U.S. PATENT DOCUMENTS 2,919,896 A * 1/1960 Wurst ..... E04B 1/3522 254/105
3,926,411 A * 12/1975 Tegtmeier ..... B66F 3/00 254/89 R
3,936,032 A * 2/1976 Waschulzik ..... E02B 17/0809 254/108

(Continued)

*Primary Examiner* — Joseph J Hail
*Assistant Examiner* — J Stephen Taylor
(74) *Attorney, Agent, or Firm* — Robert O. Blinn

(57) ABSTRACT

A jack for lifting segments of a structure includes a pair of masts, a mast base, a mast cap, a hydraulic ram, a bottom bracket and a shuttle. The masts are identical and upright with a plurality of evenly spaced holes. The mast base supports the mast and the mast cap receives the upper ends of the masts and maintains the masts in a parallel, relationship. The hydraulic ram moves between a retracted position and an extended position with a stroke distance which is significantly less than the mast height. The bottom bracket is removably pinned to the masts and receives and supports the lower end of the hydraulic ram. The shuttle receives the upper end of the hydraulic ram. The bottom bracket and shuttle, when not pinned to the masts, can slide vertically up the masts. The shuttle includes features for connecting to a segment of a structure.

7 Claims, 22 Drawing Sheets

(56) References Cited

U.S. PATENT DOCUMENTS

| | | | | | |
|---|---|---|---|---|---|
| 4,411,408 | A * | 10/1983 | Radovan | ..... | E02B 17/021<br>254/108 |
| 2011/0062399 | A1 * | 3/2011 | Kooima | ..... | B66F 3/46<br>254/92 |

* cited by examiner

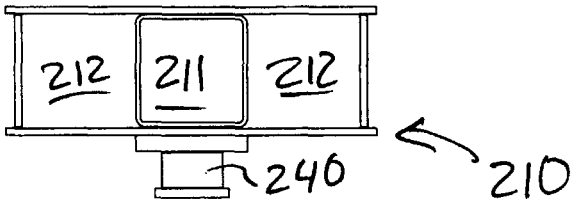
FIG. 15E
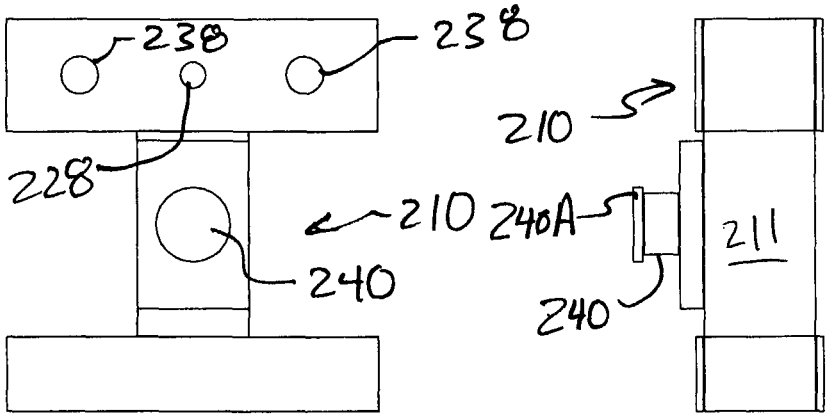
FIG. 15C FIG. 15D
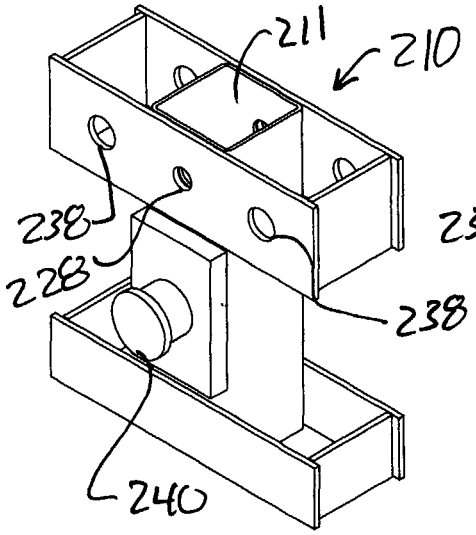
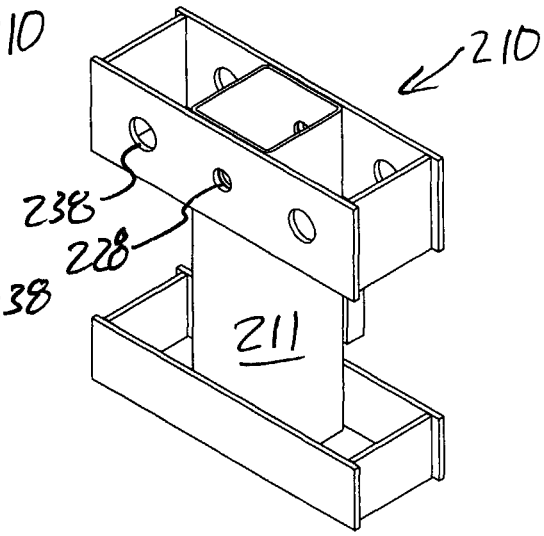
FIG. 15A FIG. 15B

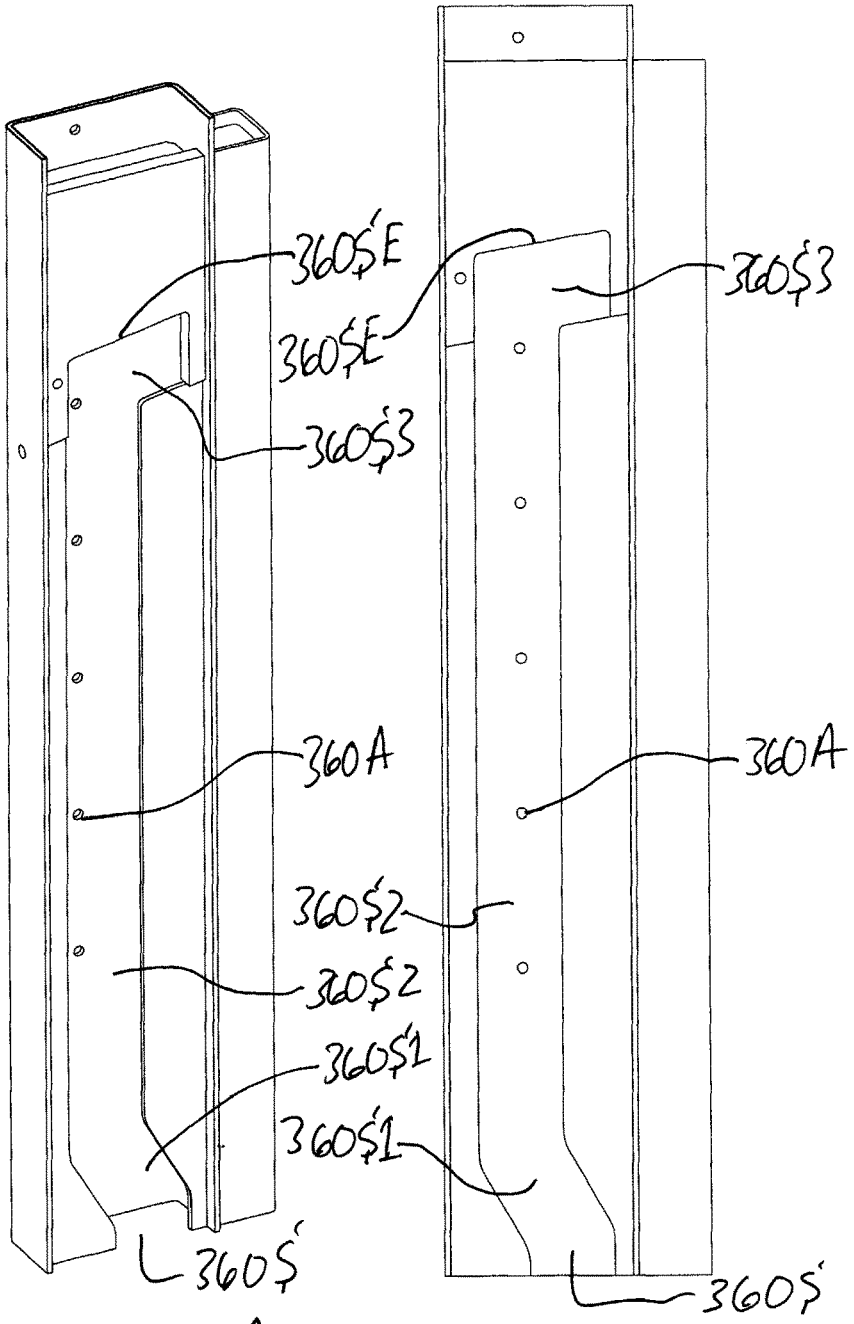
FIG. 18A
FIG. 18B
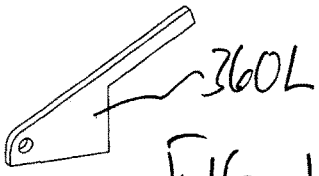
FIG. 18C

JACK WITH TWO MASTS

CROSS REFERENCES TO RELATED APPLICATIONS

This application is a continuation-in-part of U.S. patent application Ser. No. 14/326,170 filed on Jul. 8, 2014, which is incorporated herein by reference.

U.S. patent application Ser. No. 14/326,170 claimed the benefit of U.S. Provisional Patent Application No. 61/843,767 filed on Jul. 8, 2013, which is incorporated herein by reference.

FIELD

This invention relates to a two masted jack which is operable for lifting a segment of a structure.

BACKGROUND

Progressive jacks are used to construct segmented structures such as tanks and grain bins. Typically, the construction of a round segmented structure is conducted by first assembling a plurality of curved metal panels into a continuous ring. Usually, at this point a roof is attached to the first ring of panels. Next, the builder will attach a plurality of evenly spaced jacks to the panels. Once the jacks are attached to the panels, the jacks can be operated to lift the first ring of panels to a sufficient height to allow the installation of a second ring of panels under the first ring of panels. The jacks are disconnected from the first ring and connected to the second ring. The lifting and panel installation process continues until the bin is constructed to its planned height. The operation of the lifting jacks is critical to this process. It is important that all the jacks move in unison. Typically, hydraulic jacks, that is, jacks including hydraulic rams are used and a hydraulic distribution system is arranged to supply equal amounts of pressurized hydraulic fluid to the plurality of jacks at generally equal flow rates and pressure so that all of the jacks extend in unison and lift the structure evenly. Staged, telescoping jacks, as taught by applicant's U.S. Pat. Nos. 6,299,137, 6,311,952 and 6,641,115 which are incorporated herein by reference, have been used for over ten years to erect grain bins and other cylindrical tank like structures. The availability of hydraulic jacking systems of the type noted above has led to an expansion of the use of such systems. Further, the availability of such hydraulic jacks has motivated bin material suppliers to offer sets of prefabricated components increasingly larger and heavier structures.

Although telescoping jacks of the type taught by the above noted patents have been highly effective for constructing grain bins which would have been considered large ten years ago, more recent, very large bin and tank structures are beginning to test the limits of what can be practically done with telescoping jacks of the type taught by the above referenced patents. A new type of jack is needed which can accommodate significantly larger loads and which is highly versatile for lifting a wide range of loads.

SUMMARY

The above noted need is addressed by a jack for raising a segment of a structure having several connected segments. The jack, in this example, includes a pair of masts, a base, a cap, a back strut, a hydraulic ram, a bottom bracket and a shuttle. The masts are generally identical and upright, each extending from a lower end to an upper and each having an identical set of evenly spaced holes for receiving locking pins. The base is preferably adapted to rest in a stable manner on a supporting floor surface and receive and support the lower ends of the masts in a side by side, spaced relationship. The cap, in this example, receives the upper ends of the masts and maintains the masts in a parallel, spaced relationship. The back strut extends from the mast cap to the floor surface and is pinned to the mast cap and anchored to the floor surface at a location that is spaced away from the mast base. The hydraulic ram has a lower end and an upper end and is operable for movement between a retracted position and an extended position. When in the extended position, the distance between the lower end and the upper end of the hydraulic ram is greater by a stroke distance than the distance between the lower and upper ends of the hydraulic ram when in the retracted position. The stroke distance of the hydraulic ram is significantly smaller than the length of the masts. The bottom bracket connects between the masts and is adapted to be removably pinned to corresponding pairs of the evenly spaced holes of each mast. The bottom bracket receives and supports the lower end of the hydraulic ram so that the hydraulic ram is positioned generally between the masts. The bottom bracket is also able to slide vertically along the masts when it is not pinned to the masts. The shuttle connects between the masts and is adapted to be removably pinned to corresponding pairs of the evenly spaced holes of each mast. The shuttle receives the upper end of the hydraulic ram so that the upper end of the hydraulic ram is also located generally between the masts. The shuttle also can slide vertically up the masts when the shuttle is not pinned to the masts. The shuttle also has features for connecting to a segment of a structure.

Jacks like the one described above, when in use, would be arranged in a set, which, in most cases, would include six or more jacks. The shuttles of the jacks would be typically connected to a set of interconnected curved panels which form a ring of panels, which, in turn, would be one horizontal ring of a cylindrical structure. The hydraulic rams of the jacks would be connected to a common source of pressurized hydraulic fluid which would be controlled by an operator to power the hydraulic rams in unison to cause the hydraulic rams to move, in unison, toward the extended position. Once the hydraulic rams have reached the extended position, the shuttles would be pinned to their respective masts and the bottom brackets would be unpinned. When in this configuration, the hydraulic rams are then contracted to the contracted position which causes all of the bottom brackets to be raised toward the shuttles. If the operator pins the bottom brackets to the masts and unpins the shuttles, the above described steps can be repeated until the panels are raised sufficiently above the surface of the floor to allow a next ring of panels to be installed. The jacks would be disconnected from the first set of panels and connected to the next set of panels and the above described steps would be repeated until it would be possible to install yet another ring of panels. The above described are repeated until a tank or bin having a desired height has been assembled.

Because the bottom bracket and the shuttle may be pinned to a multitude of spaced holes in the masts, then the bottom bracket and the shuttle may be arranged to accommodate a wide range of hydraulic rams of varying stroke lengths. Accordingly, hydraulic rams having relatively long stroke lengths may be employed to rapidly lift structures which are relatively light weight. However, as the structure increases in height and weight, or if a very heavy structure is under construction, hydraulic rams having much greater load lifting capacity, but shorter stroke lengths could be selected. With such a high load configuration, more shuttle cycles will be required but the load may be safely and accurately lifted. It should be considered by the skilled reader that a set of hydraulic rams which are operating well below their load carrying capacities are more likely to extend in unison than hydraulic rams operating near the limits of their load lifting capacities. Uniform lifting is of paramount importance when building up a structure in this manner.

Still further, the back strut may be fashioned as a telescoping back strut so that different mast lengths may be selected without having to change any of the other components of the jack. Taller masts might only require thicker walls to have sufficient structural strength. The designer need only select mast cross section dimensions which would provide universal compatibility for various contemplated mast heights. Accordingly, the above described jacks are extremely versatile and may be reconfigured at will to safely accommodate a very wide range of construction needs.

BRIEF DESCRIPTION OF THE DRAWINGS

FIG. 15A is a first perspective view of a shuttle.

FIG. 15B is a second perspective view of a shuttle.

FIG. 15C is a front view of a shuttle.

FIG. 15D is a side view of a shuttle.

FIG. 15E is a top view of a shuttle.

FIG. 18A is a perspective view of one embodiment of an indexing bolt bracket.

FIG. 18B is a front view of one embodiment of an indexing bolt bracket.

FIG. 18C is a perspective view of the latch plate of an indexing bolt bracket.

DETAILED DESCRIPTION

Figure 1A:
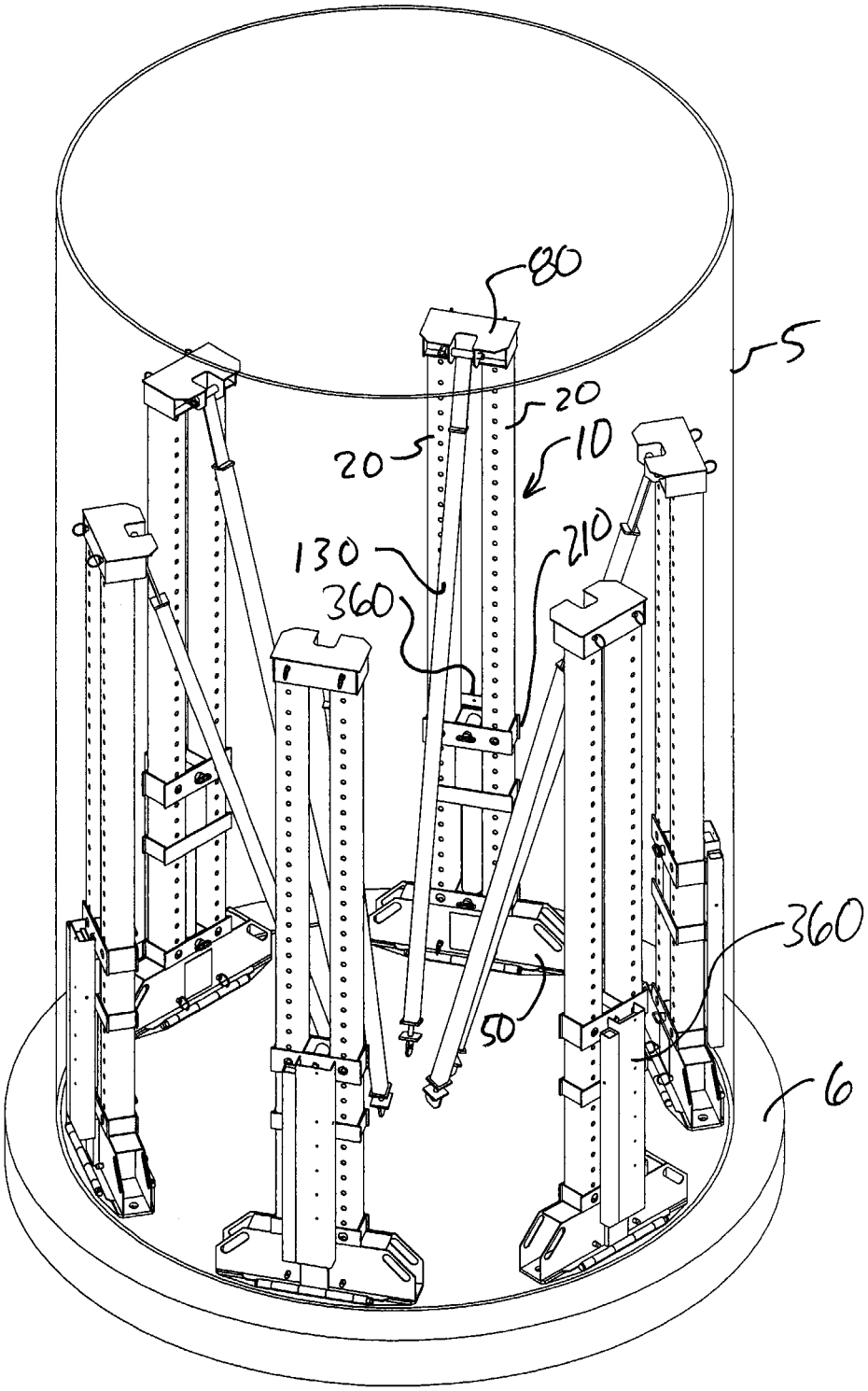
FIG. 1A is a perspective view of a pattern of one embodiment of double masted jacks arranged for lifting a ring segment showing the ring segment resting on a foundation pad.
Figure 1B:
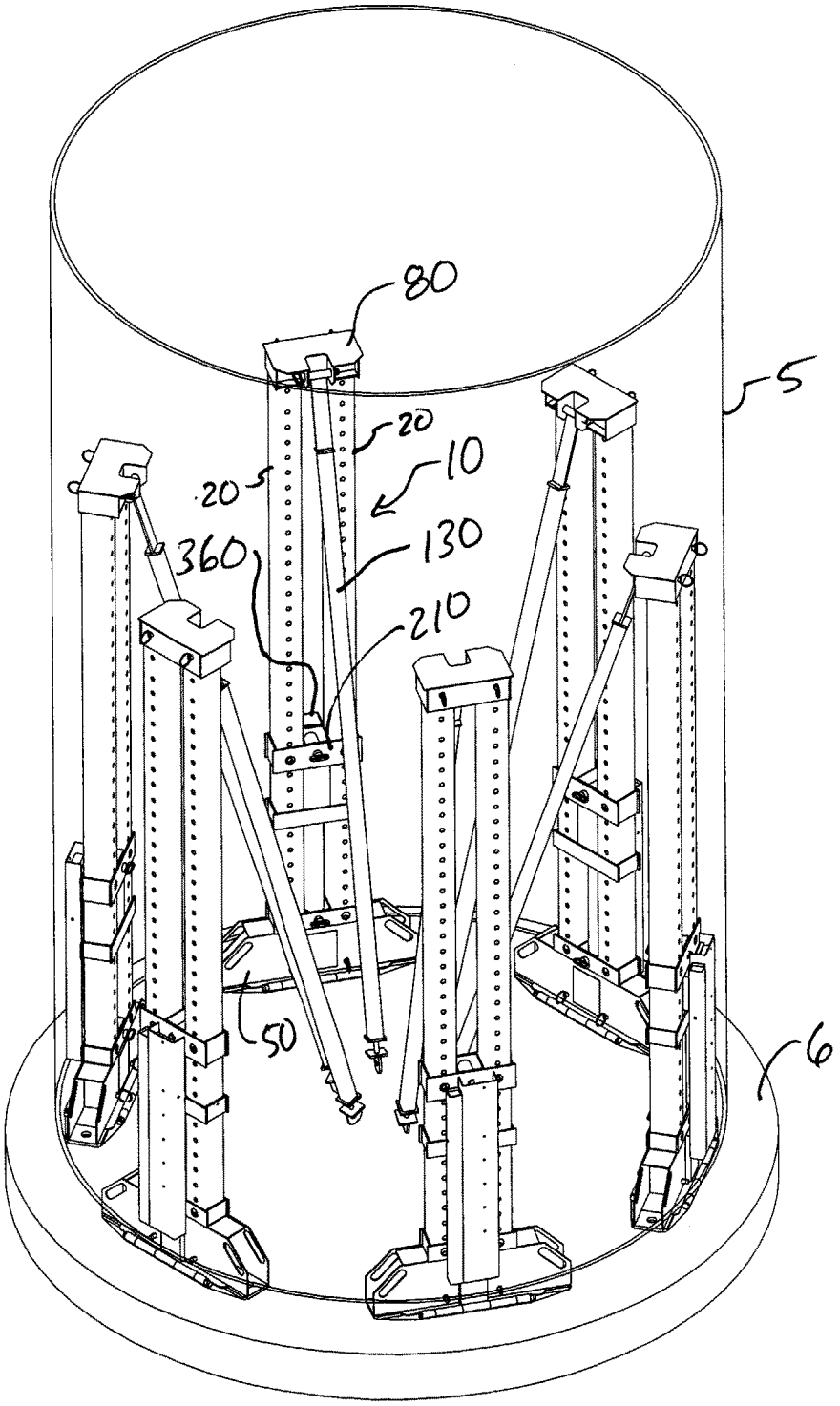
FIG. 1B is a perspective view of a pattern of one embodiment double masted jacks arranged for lifting a ring segment showing the ring segment slightly lifted from the foundation pad.
Figure 1C:
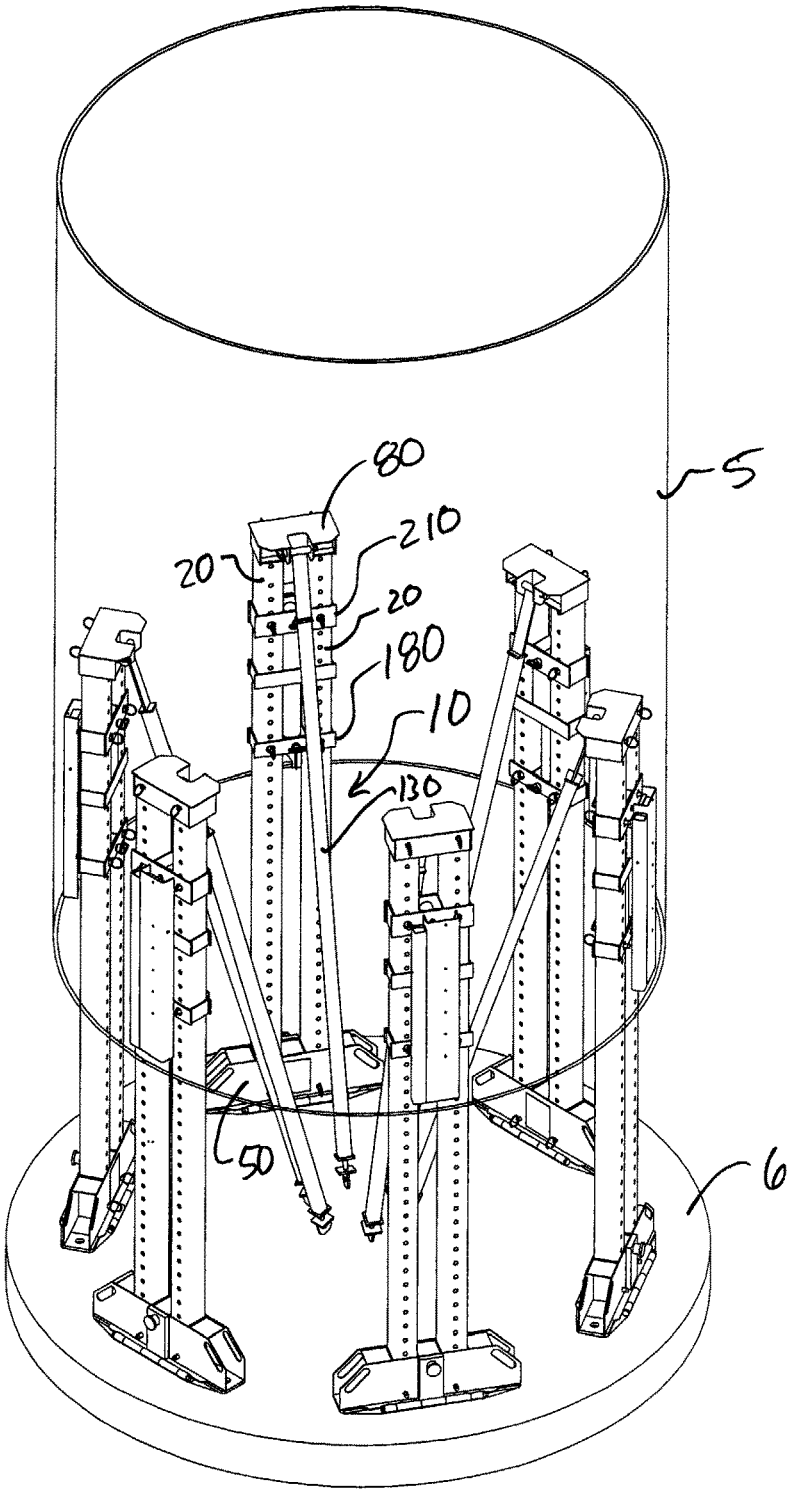
FIG. 1C is a perspective view of a pattern of one embodiment of double masted jacks arranged for lifting a ring segment showing the ring segment lifted from the foundation pad.
Figure 5:
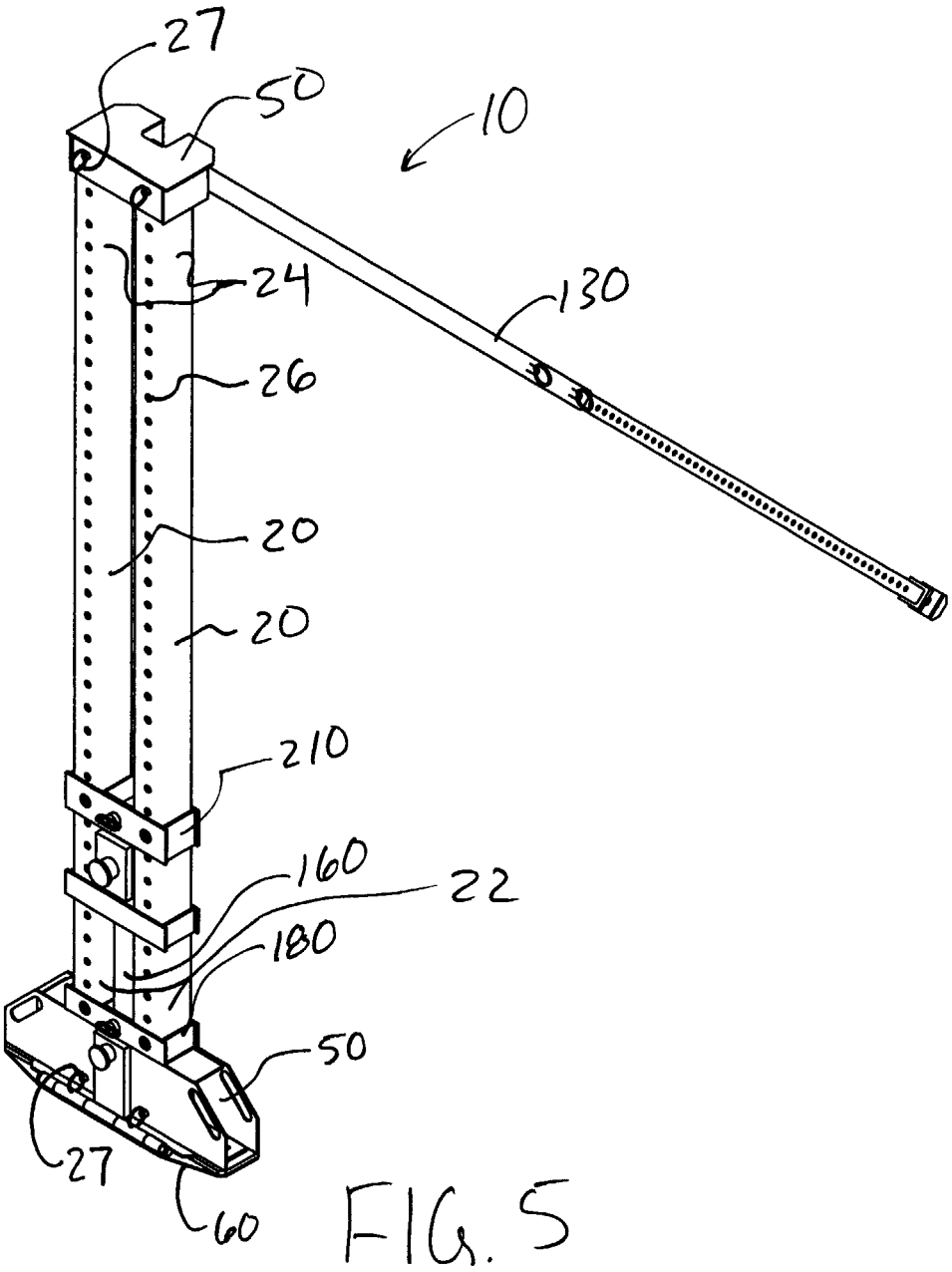
FIG. 5 is a first perspective view of one embodiment of a double masted jack.
Figure 6:
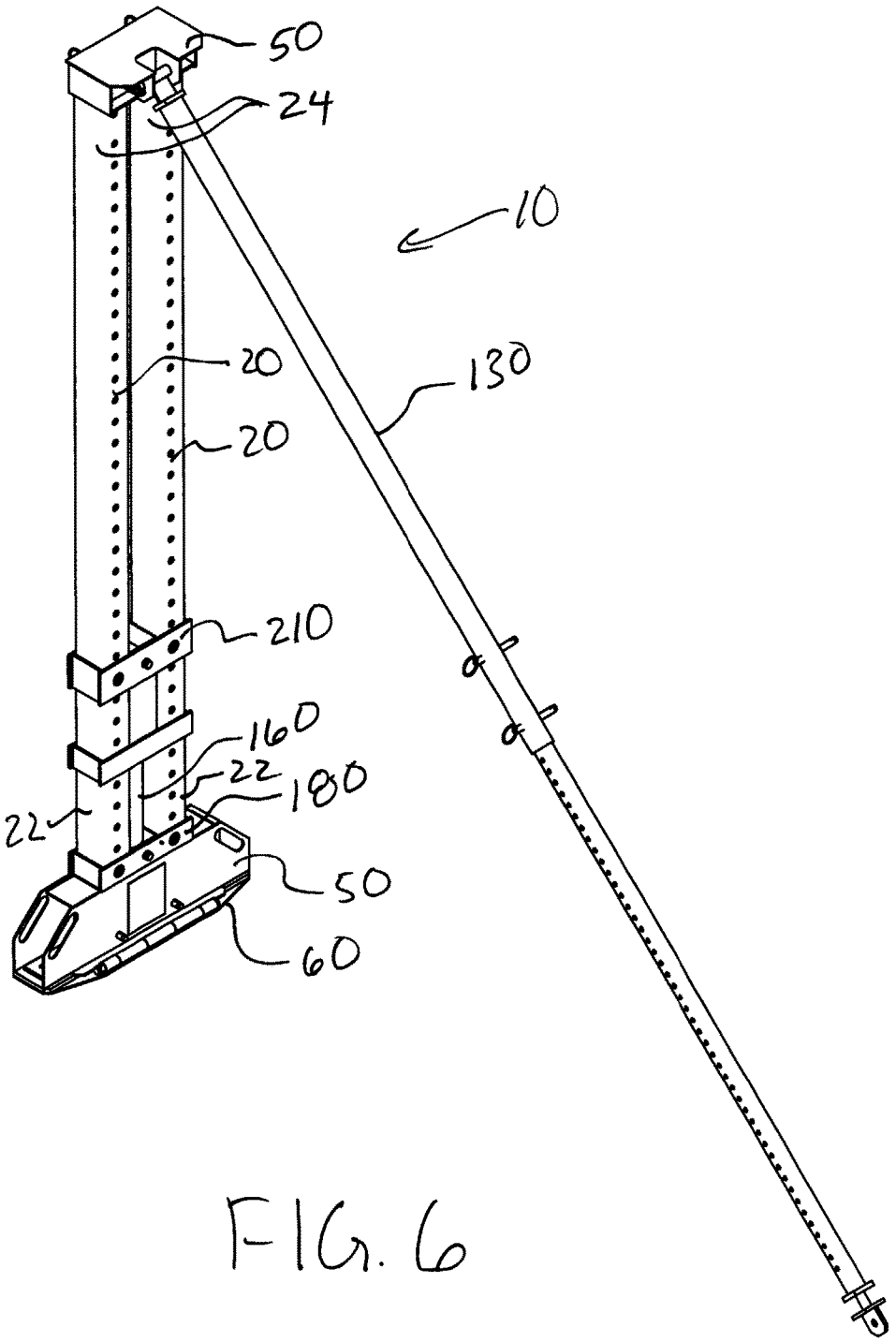
FIG. 6 is a second perspective view of a mast base of one embodiment of a double masted jack.
Figure 7A:
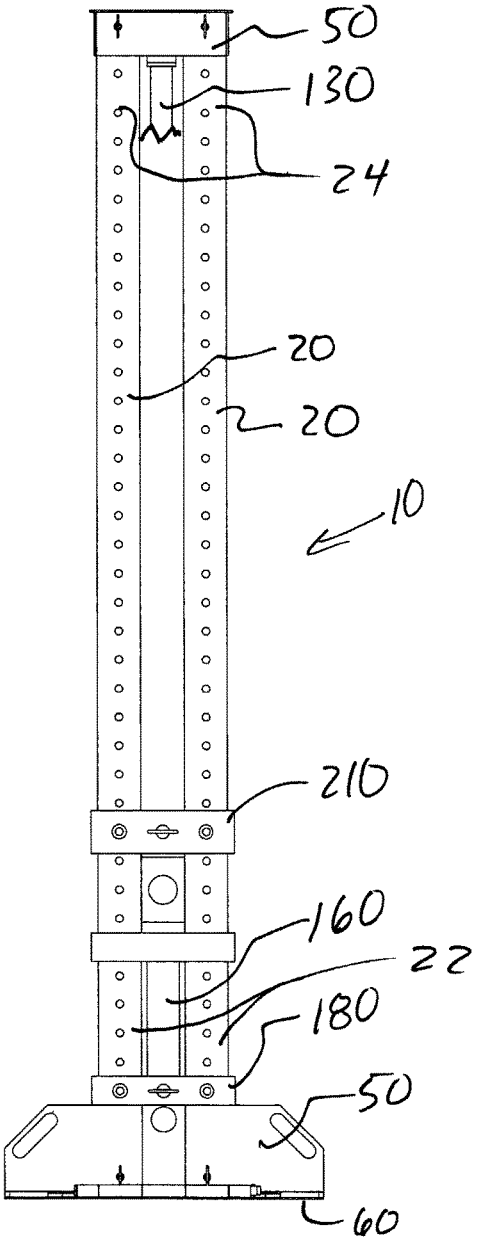
FIG. 7A is a first front view of one embodiment of a double masted jack with the hydraulic ram in the retracted position and the shuttle in the lowest position.
Figure 7B:
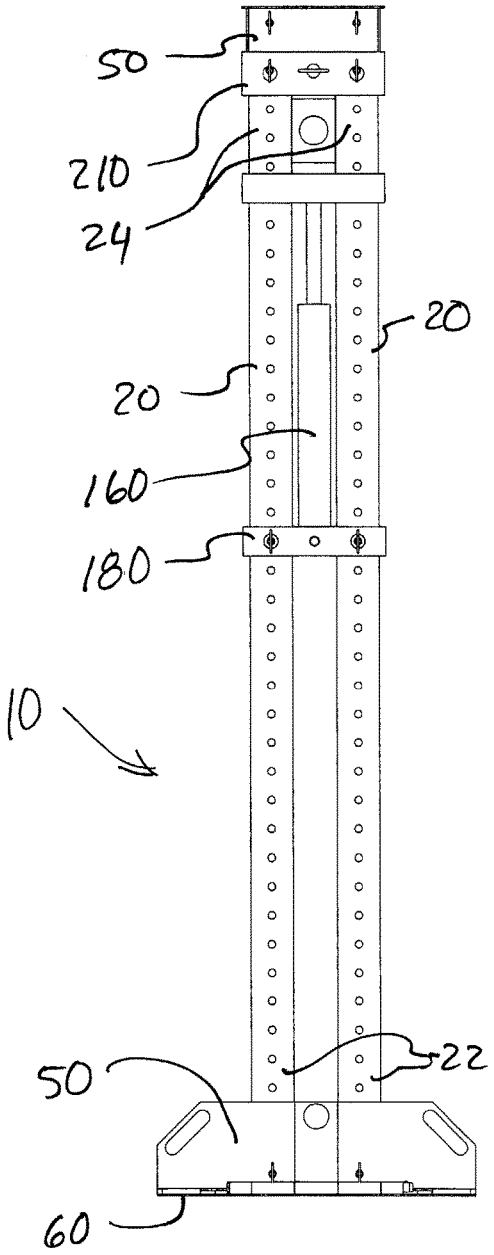
FIG. 7B is a second front view of one embodiment of a double masted jack with the hydraulic ram in the extended position and the shuttle in the hightest position.

Referring to the figures, FIGS. 1A-1C provide a perspective views of one embodiment of a set of jacks 10 being used to lift a structure 5 which is being assembled on a foundation pad 6. FIGS. 5 and 6 provide a perspective views of one embodiment of one jack 10. As can be seen in FIGS. 5 and 6, jack 10 includes a pair of masts 20, a mast base 50, a mast cap 80, a back strut 130, a hydraulic ram 160, a bottom bracket 180 and a shuttle 210.

Figure 2:
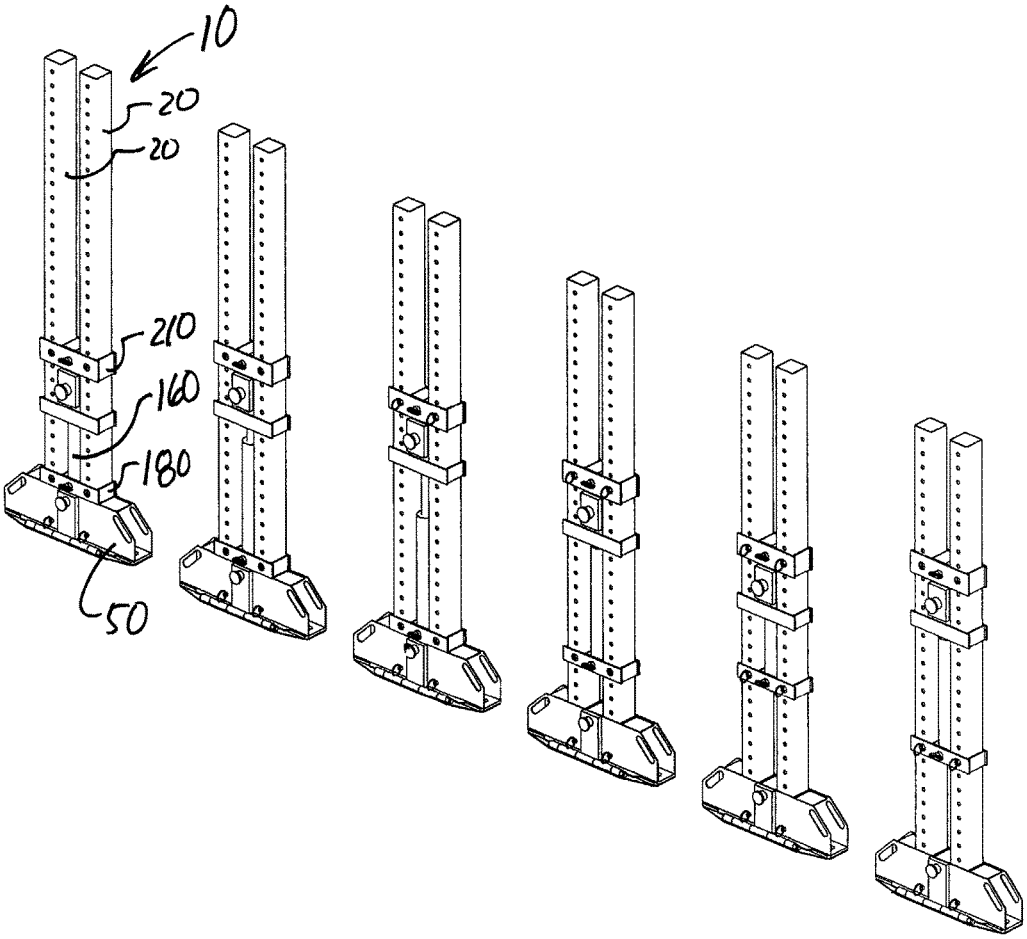
FIG. 2 is a series of perspective views of one embodiment double masted jack showing one cycle of the extension of the hydraulic ram to raise the shuttle and the retraction of the hydraulic ram to lift the shuttle and return the hydraulic ram to the retracted position in preparation for raising the shuttle to a second raised position.

Masts 20, in this example, are fashioned from square steel tubes and are preferably identical. Square steel tube are selected because they are readily available, relatively inexpensive and optimal for transferring large loads in compression. Further, square steel tubes with identical outside dimensions may be obtained by varying the steel tube wall thickness. Thus, a 10 foot mast may need to have relatively thick walls to resist buckling while a 6 foot mast may only need relatively thin walls. Since the outside dimensions of both masts may be identical, both masts may be used interchangeably with the remaining components of jack 10. We will consider one mast 20 while the skilled reader understands that both masts 20 have exactly the same features. As can be seen in FIG. 2, mast 20 is has a square cross section and extends from a lower end 22 to an upper end 24. When in use, masts 20 are held upright and are spaced apart in a parallel side by side relationship. Two of the sides of mast 20 present a plurality of spaced, aligned holes 26. Holes 26 are defined in corresponding pairs which are at the same height and are adapted for receiving locking pins 27 as will be described below. If holes 26 are spaced too closely, the structural integrity of mast 20 may be compromised. Further, if holes 26 are spaced too closely, an operator may have difficulty knowing that corresponding holes 26 on both masts 20 which are at the same height have been selected when either bottom bracket 190 or shuttle 210 are being pinned to masts 20. If holes 26 are spaced too far apart, then jack 10 will be less versatile in terms of selecting a level to which a load is lifted or in terms of being able to select hydraulic rams of varying stroke lengths.

Figure 12C:
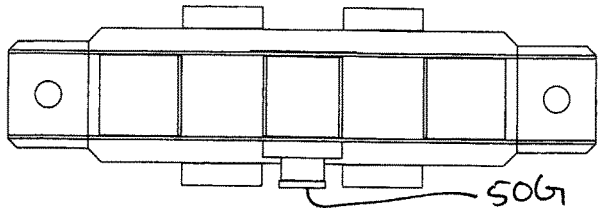
FIG. 12C is a top view of a base.
Figure 12B:
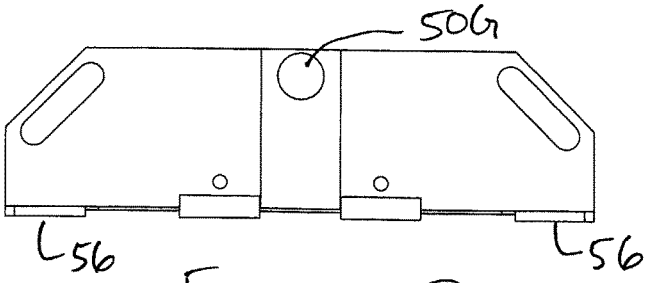
FIG. 12B is a front view of a base.
Figure 12D:
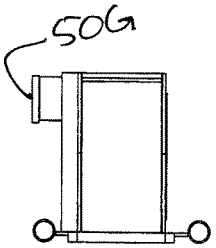
FIG. 12D is an end view of a base.
Figure 12A:
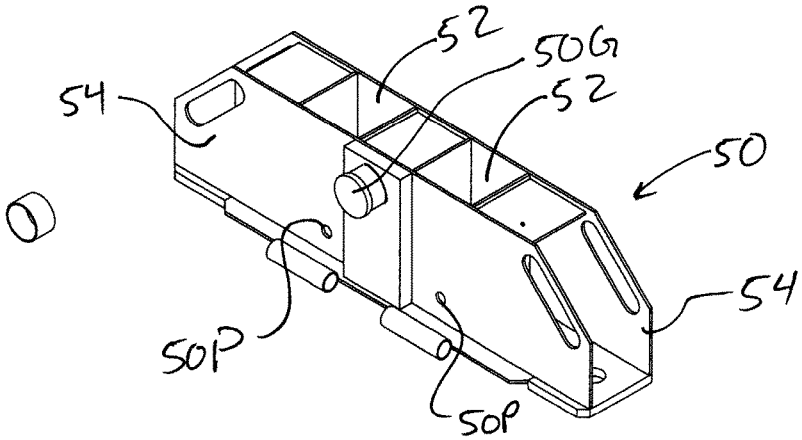
FIG. 12A is a perspective view of a base.
Figure 13D:
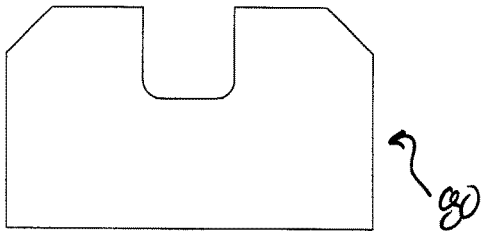
FIG. 13D is a top view of a mast cap.
Figure 13E:
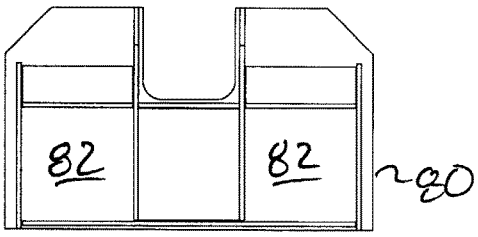
FIG. 13E is a bottom view of a mast cap.
Figure 13C:
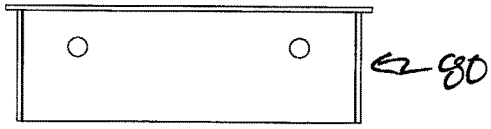
FIG. 13C is a side view of a mast cap.
Figure 13F:
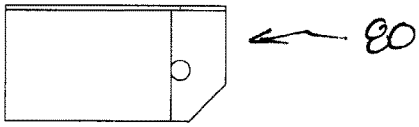
FIG. 13F is an end view of a mast cap.
Figure 13A:
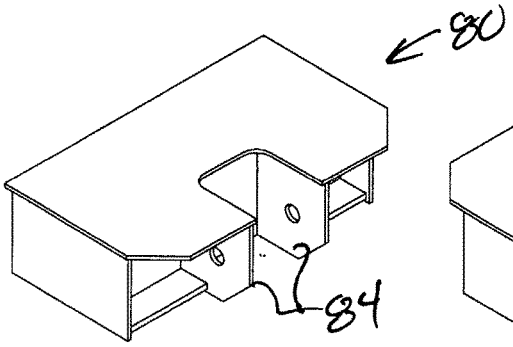
FIG. 13A is a first perspective view of a mast cap.
Figure 13B:
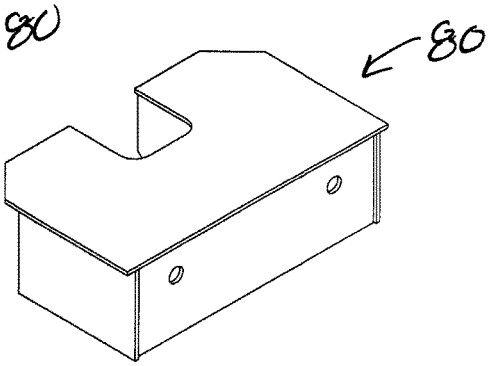
FIG. 13B is a second perspective view of a mast cap.

Mast base 50 provides a stable platform for receiving and supporting masts 20. As can be best seen in FIGS. 5 and 6, mast base 50 receives lower ends 22 of masts 20 and supports masts 20 securely in a spaced apart relationship as shown in FIGS. 5 and 6. Preferably, mast base 50 has pin holes 50P which correspond to the lowest holes in masts 20. Mast base 50 presents two spaced pockets 52 which are sized to slidably receive lower ends 22 of masts 20. Lock pins engage the corresponding holes and secure lower ends 22 of masts 20 to mast base 50. The pockets are arranged so that masts 20 are located as precisely as possible so that the spacing between masts 20 is such that other components which will be described below fit and slide easily up and down masts 20. As can be best seen in FIG. 12A, mast base 50 has extending side portions 54 which present foot pads 56, wide base. Mast base 50 and the lower end of back strut 130 provide jack 10 with a very stable three point support. Mast base 50 also presents a base guide pin 50G which extends horizontally from the center portion of mast base 50. The purpose of base guide pin 50G will be described in greater detail below.

Figure 19B:
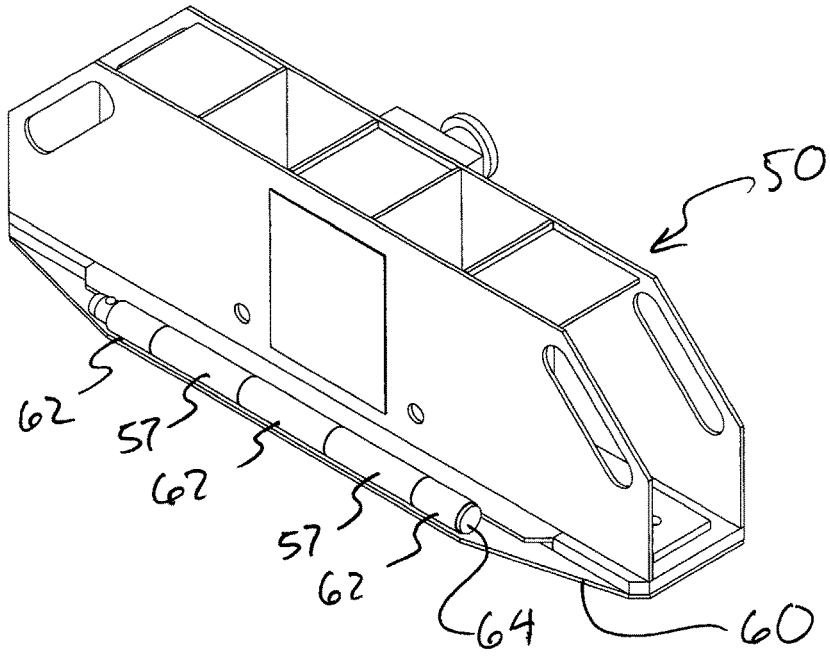
FIG. 19B is a perspective view of one embodiment of a base assembly showing the base in an upright secured position suitable for supporting masts.
Figure 19A:
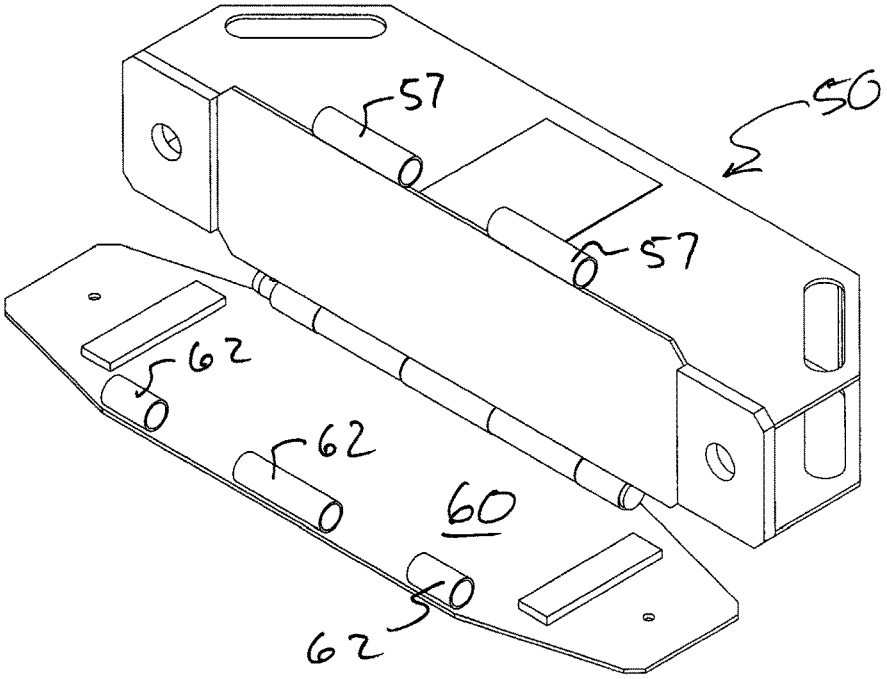
FIG. 19A is a perspective view of one embodiment of a base assembly showing the base in a horizontal position suitable for receiving masts.

As is shown in FIGS. 19A and 19B, in this example, mast base 50 is hinged to a base plate 60. The purpose of this arrangement may be understood when the skilled reader considers how a jack 10 might be assembled. Initially, base plates 60 are secured to a foundation pad 6 in a pattern much as shown in FIGS. 1A-1C. When a base plate 60 is initially secured to a foundation pad, mast base 50 may be hinged to plate 60 as shown in FIG. 19A. Aligned tube sections 62 are fixed to base plate 60 and corresponding aligned tube sections 57 are also fixed to the lower edge of mast base 50. After this step is completed, a worker can install masts 20 and assemble the remainder of the jack in a horizontal orientation. Once jack 10 is fully assembled, it can be rotated into an upright position as shown in FIGS. 5 and 6 and secured with back strut 130. A securing rod 64 is inserted through the aligned tube sections 57 and 62 to secure mast base 50 in the upright position.

In this example, mast cap 80 performs two functions. Mast cap 80 receives and secures upper ends 24 of masts 20. Pins 27 and corresponding holes may also be used to secure mast cap 80 to the upper ends of masts 20. As was the case with mast base 50, mast cap 80 present two spaced identical pockets 82 which are also sized to closely receive the upper ends 24 of masts 20. Pockets 82 are sized and spaced precisely to correspond to pockets 52 of mast base 50, so that masts 20 are supported in a precise parallel relationship.

Figure 3:
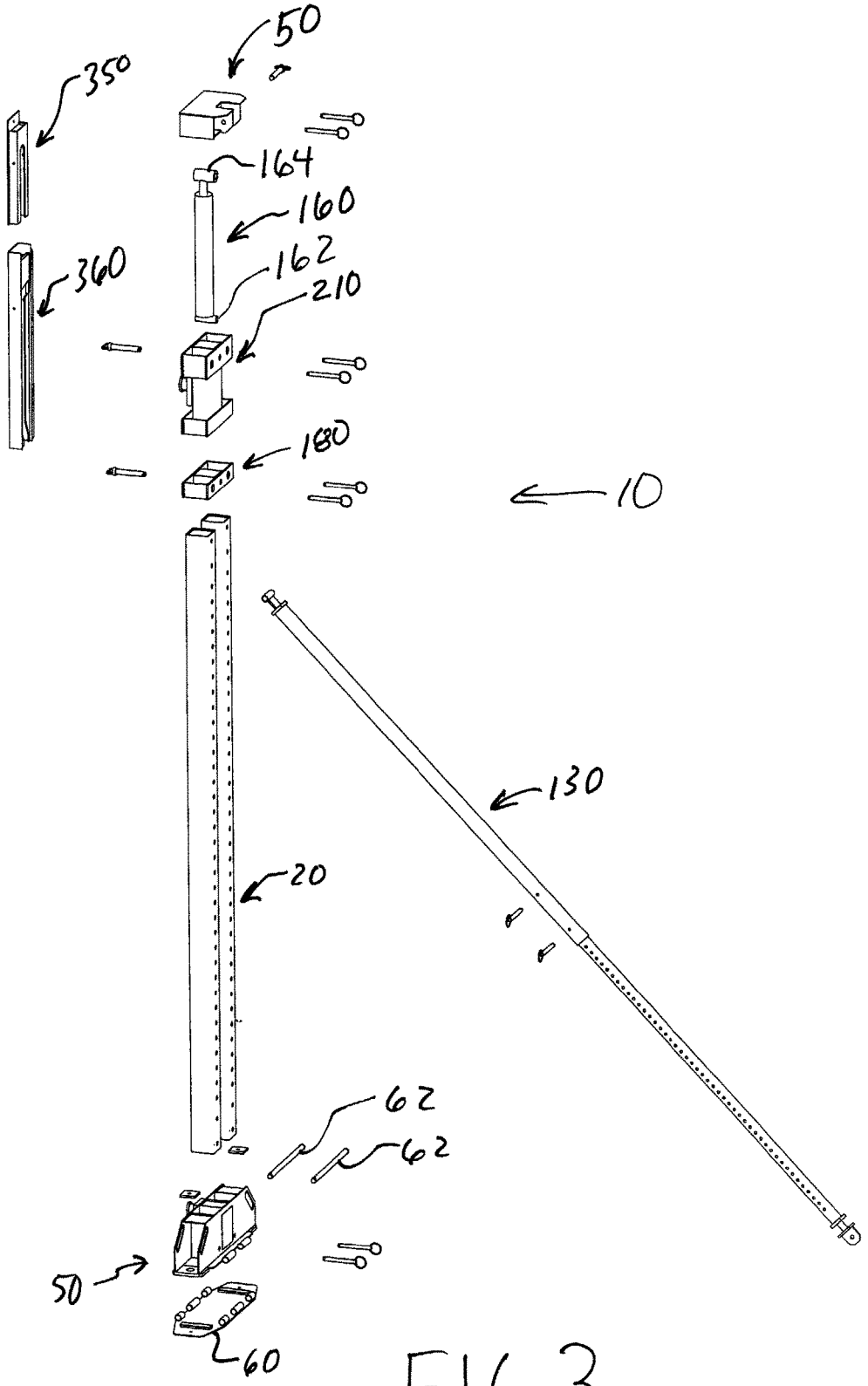
FIG. 3 is a first exploded perspective view of one embodiment of a double masted jack.
Figure 4:
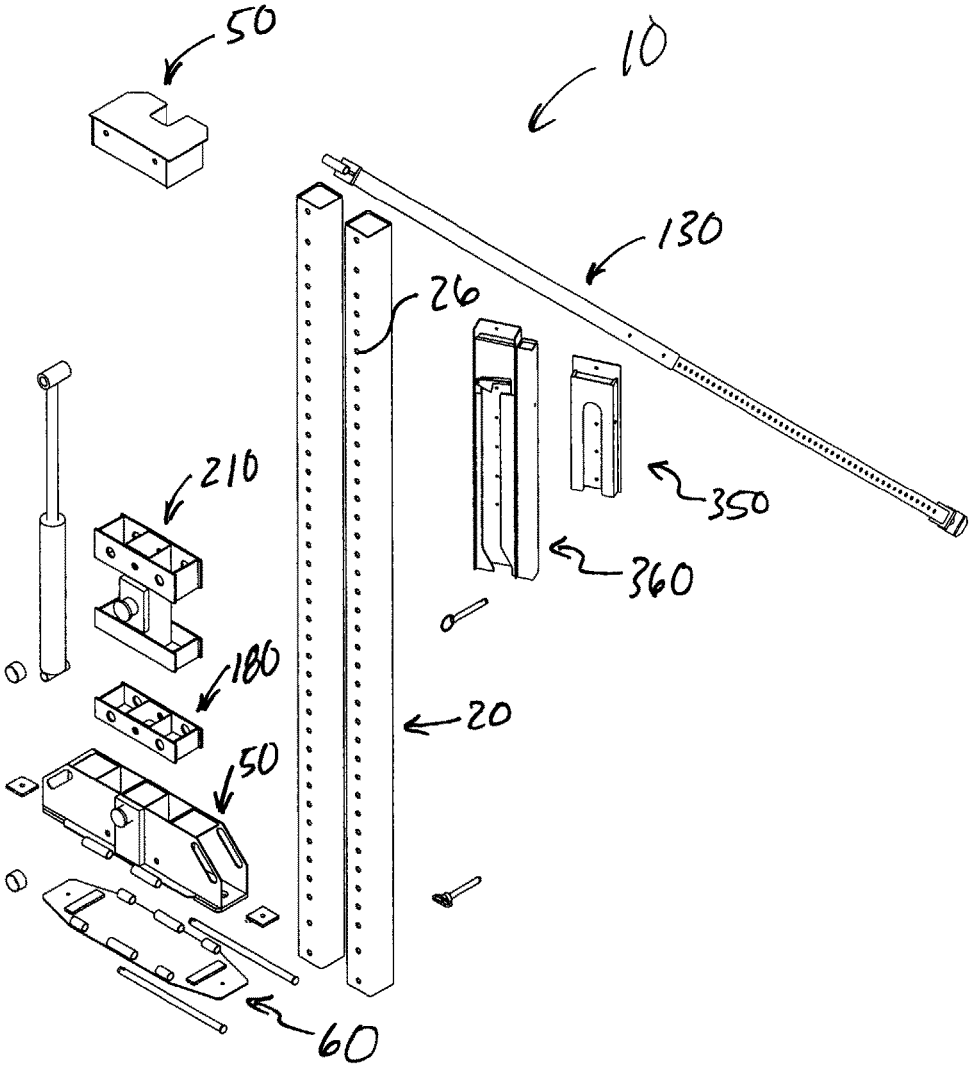
FIG. 4 is a second exploded perspective view of one embodiment of a double masted jack.

In this example mast cap 80 has a clevis feature 84 for connecting to the upper end of back strut 130. Back strut 130 includes a first telescoping portion 132 which receives a second telescoping portion 134. Second telescoping portion can be adjustably slid and locked relative to first telescoping portion 132. Accordingly, back strut 130 is able to accommodate masts 20 of varying height. As can be seen in FIGS. 2 and 3, back strut 130 has an anchor bracket 134 for fixing its lower end to the construction surface.

Hydraulic ram 160 provides the force for lifting structural segments. Although one particular hydraulic ram appears to be illustrated in FIG. 2, the skilled reader should appreciate, hydraulic ram 160 may take several forms. An elongated, narrower hydraulic ram having a relatively long stroke length may be used to lift relatively light structural segments or light structures by stages which are relatively large. Thus, with such an arrangement, only a few cycles may be needed to raise a ring of panels to the next level. The drawback for using hydraulic rams with long stroke lengths is that when the load is heavy, relatively high pressure hydraulic fluid is needed to lift the load. When the pressure of the hydraulic fluid in the system increases, it becomes increasingly difficult to cause all of the hydraulic rams in a set to lift at the same rate. Larger diameter hydraulic rams with relatively short stroke lengths have the ability to lift larger loads and so to do so with greater uniformity across a set of hydraulic rams. When lifting a structure, it is of great importance that all of the jacks lift the structure at the same rate.

It is contemplated that the components of jack 10 are arranged so that a wide range of hydraulic rams can be employed. The skilled reader will appreciate hydraulic ram 160 will have features at its lower end and its upper end for connecting to other components of jack 10 as will be described below. Ram 160 is arranged to move between a retracted position and an extended position. The difference between the lengths of ram 160 when in the retracted and extended positions is known as the stroke distance of hydraulic ram 160. While another type of actuator other than a hydraulic ram may be selected, the applicant has found that the most cost effective and practical device for raising structural components is a hydraulic ram (or hydraulic cylinder) having the ability to extend and retract depending on how pressurized hydraulic fluid is valved to the hydraulic ram.

Hydraulic ram 160 is supported at its lower end by bottom bracket 180 which is illustrated in detail in FIGS. 16A-16D. Bottom bracket 180 includes a central portion 181 from which extend a pair of plates 184 which together with central portion 181 define side channels 182. Side channels 182 are sized and spaced to receive masts 20 so that bottom bracket 180 can slide up and down masts 20 when it is necessary to do so. Bottom bracket also has holes 188 which correspond to holes 26 in masts 20. Lock pins 27 are passed through the corresponding bottom bracket holes 188 and mast holes 26 to secure bottom bracket 180 when it is necessary to do so. Bottom bracket holes 188 are preferably enlarged to facilitate assembly. Central portion 181 of bottom bracket 180 defines a central pocket 186 which is arranged to be located between masts 20 and to receive the lower end of hydraulic ram 160. Preferably, central portion 181 also has features which may be pinned or locked to establish a fixed connection between the lower end of hydraulic ram 160 and bottom bracket 180. In this example, a pair of aligned holes 189 in the walls of central portion 181 correspond to pin 27A and lug 162 at the lower end of hydraulic ram 160. Passing pin 27A through holes 186 and lug 162 secures the lower end of hydraulic ram 160 to bottom bracket 180.

The upper end of hydraulic ram 160 is received by shuttle 210 which is shown in detail in FIGS. 15A-15E. As was the case with bottom bracket 180, in this example, shuttle 210 includes a central portion 211 and extending side plates 212 and 214 which present side channels 212A. Side channels 212 are sized and spaced to receive masts 20 so that shuttle 210 can slide up and down masts 20. Shuttle 210 also has holes 214 which correspond to holes 26 in masts 20. Lock pins 27 are passed through the corresponding shuttle holes 238 and mast holes 26 to secure shuttle to masts 20 when it is necessary to do so. This is done a the end of lift stage to secure shuttle 210 and the load it carries to masts 20 prior to contracting hydraulic ram 160 prior to a subsequent extension and lifting of shuttle 210 and its load. Shuttle holes 238 are preferably enlarged to facilitate assembly. Central portion 211 also has features which may be pinned or locked to establish a fixed connection between the upper end of hydraulic ram 160 and shuttle 210. In this example, a pair of aligned holes 228 in the walls of central portion 211 correspond to a pin 27A and lug 164 at the upper end of hydraulic ram 160. Passing pin 27A through holes 228 and lug 164 of hydraulic ram 160 secures the upper end of hydraulic ram 160 to shuttle 210. Holes 228 may also be enlarged to facilitate assembly. In this example, and as can be seen in FIGS. 15A and 15B-15E, a king pin 240 is fixed to and extends horizontally from center portion 211 of shuttle 210. King pin 240 includes a cylindrical body and a round cap 240A. King pin 240 is fashioned to be received by a slot which is presented by a bolt bracket which is fixed to the inside wall of the structure being lifted. This arrangement and relationship will be described in greater detail below.

Figure 8A:
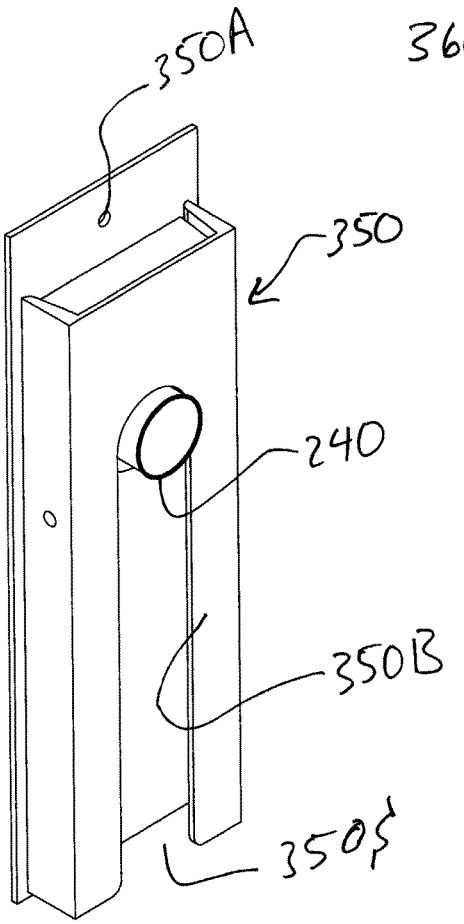
FIG. 8A is a perspective view of a bolt bracket for attachment to the inside wall of a structure.
Figures 17A, 17B:
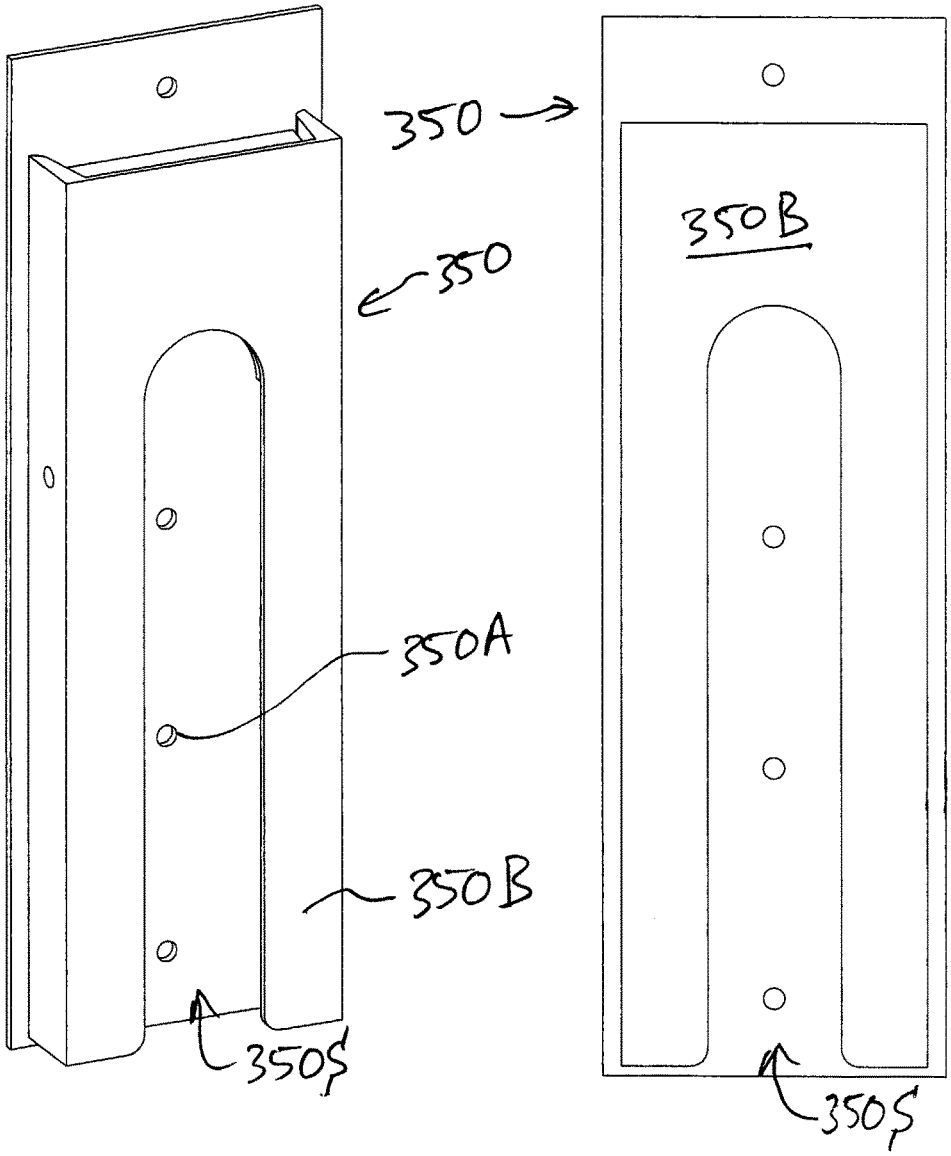
FIG. 17A is a perspective view of a bolt bracket.
FIG. 17B is a front view of a bolt bracket.

In this example, two types of bolt brackets are available for use with jacks 10. The first type of bolt bracket, bolt bracket 350 shown in FIG. 8A is for use with a non-indexing bin structure. Typically, bin ring segments are fashioned from a set of curved panels that are fastened together along their vertical margins by means of a series of corresponding fastener holes and fasteners. Either bolt bracket 350 or bolt bracket 360 is temporarily bolted to this vertical seam in order to present a slot for receiving the king pin 240 of shuttle 210 described above. Bolt bracket 350, which is shown in greater detail in FIGS. 17A and 17B, presents a series of fastener holes 350A for bolting to the panel seam of the inside wall of bin 5. Bolt bracket 350 includes a channel 350B which presents a vertical slot 350S which is sufficiently narrow to retain cap 240 of king pin 240. Thus, shuttle king pin 240 is received by slot 350S so that when hydraulic ram 160 is extended, bolt bracket 350 is lifted and any panel to which it is attached is lifted.

Either bolt bracket 350 or bolt bracket 360 is temporarily bolted to this vertical seam in order to present a slot for receiving the king pin 240 of shuttle 210 described above. Bolt bracket 350, which is shown in greater detail in FIGS. 17A and 17B, presents a series of fastener holes 350A for bolting to the panel seam of the inside wall of bin 5. Bolt bracket 350 includes a channel 350B which presents a vertical slot 350S which is sufficiently narrow to retain cap 240 of king pin 240. Thus, shuttle king pin 240 is received by slot 350S so that when hydraulic ram 160 is extended, bolt bracket 350 is lifted and any panel to which it is attached is lifted.

Figure 8B:
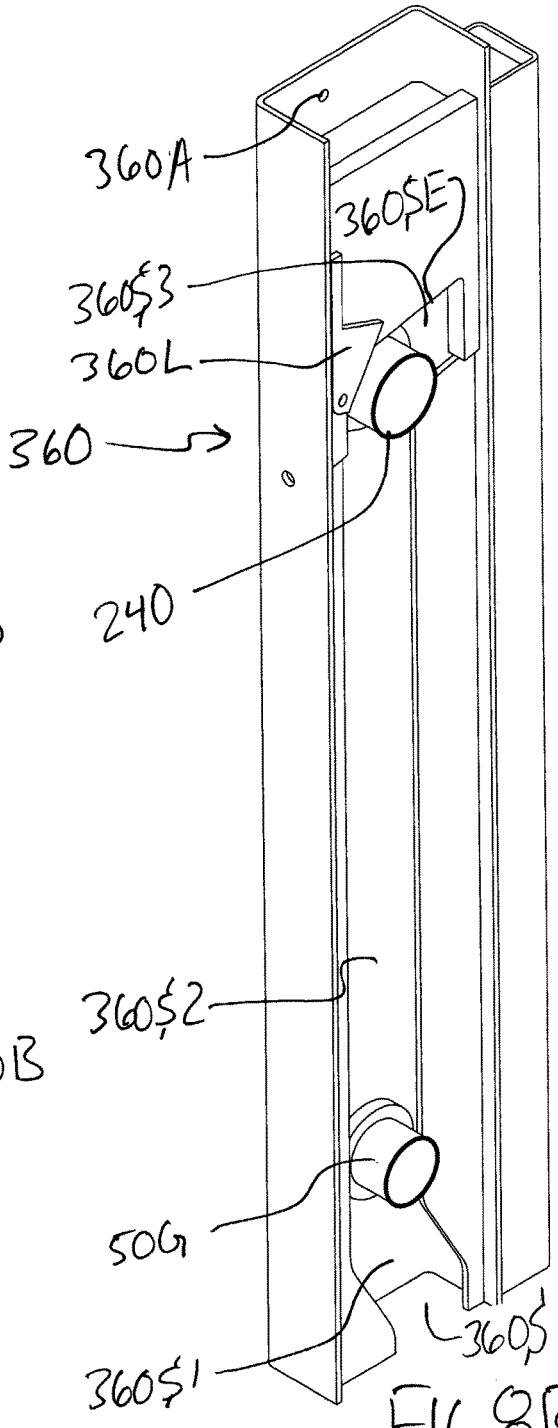
FIG. 8B is a perspective view of one embodiment of an indexing bolt bracket for attachment to the inside wall of a structure.

The second type of bolt bracket, indexing bolt bracket 360 shown in FIG. 8B is for use with an indexing bin structure. The purpose of indexing bolt bracket 360 is to facilitate the lifting of a ring segment as is the case with non-indexing bolt bracket 350, but also to facilitate the rotation of the bin structure so that the vertical seams between panels of the next ring segment can be offset by a desired distance from the previous vertical seams. One common offset distance is 2.125 inches. The skilled reader will readily appreciate that jacks 10 which are bolted to foundation pad 6 can not be moved to accommodate this offset. Offset bolt bracket 360 addresses this problem.

Indexing bolt bracket 360 also includes a slot 360S and a series of fastener holes 360A suitable for receiving fasteners common to a vertical seam between panels of a ring segment of bin 5. However, in this example, as is shown in FIGS. 18A and 18B, slot 360S includes a first slot outlet portion 360S1 which jogs to the left, a vertical slot portion 360S2 and an inclined slot portion 360S3 which is directed back to the right side and which is bounded at its upper extent by an inclined edge 360SE. In practice, as is shown in FIG. 8B, indexing bolt bracket is initially fastened to a ring segment seam using fastener holes 360A with base guide pin 50G and king pin 240 received by vertical slot portion 360S2. As can be seen in FIG. 8B, a pivotably mounted latch 360L is rotated up to accommodate king pin 240.

Figure 9B:
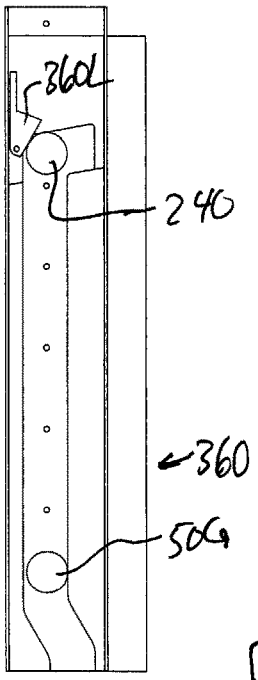
FIG. 9B is a first front view of one embodiment of the indexing bolt bracket for attachment to the inside wall of a structure showing a guide pin and a king pin being received by a vertical portion of king pin channel presented by the indexing bolt bracket shown prior to the beginning of a lift cycle.
Figure 9C:
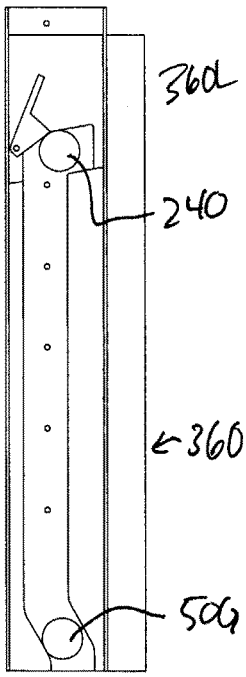
FIG. 9C is a second front view of one embodiment of the indexing bolt bracket for attachment to the inside wall of a structure showing a guide pin and a king pin being received by a vertical king pin channel presented by the indexing bolt bracket shown at the beginning of a lift cycle when the lower edge of the ring segment has lifted out of contact with the foundation pad thereby allowing the ring segment to rotate as the king pin translates along the top sloped edge of upper transverse portion of the king pin channel and as the latch begins rotating toward the latched position.
Figure 9D:
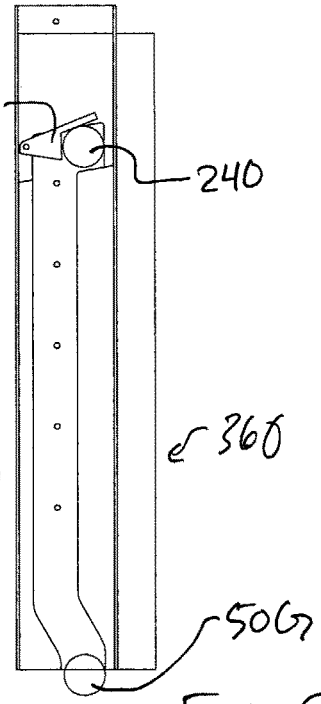
FIG. 9D is a third front view of one embodiment of the indexing bolt bracket for attachment to the inside wall of a structure showing a guide pin and a king pin being received by a vertical channel presented by the indexing bolt bracket shown after the beginning of a lift cycle when the ring segment has lifted off the foundation pad and the king pin has translated to the right side of the transverse portion of the king pin slot and after the latch has descended to the latched position.
Figure 9A:
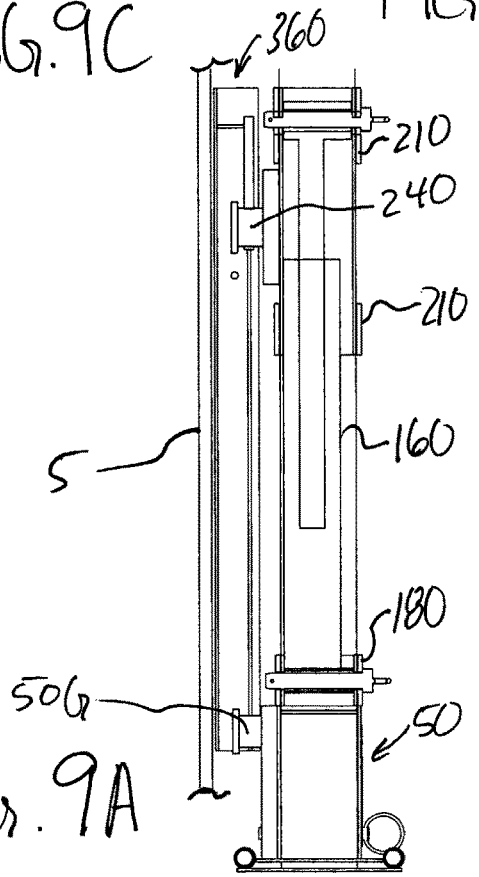
FIG. 9A is a side view of one embodiment of an indexing bolt bracket for attachment to the inside wall of a structure.
Figure 10A:
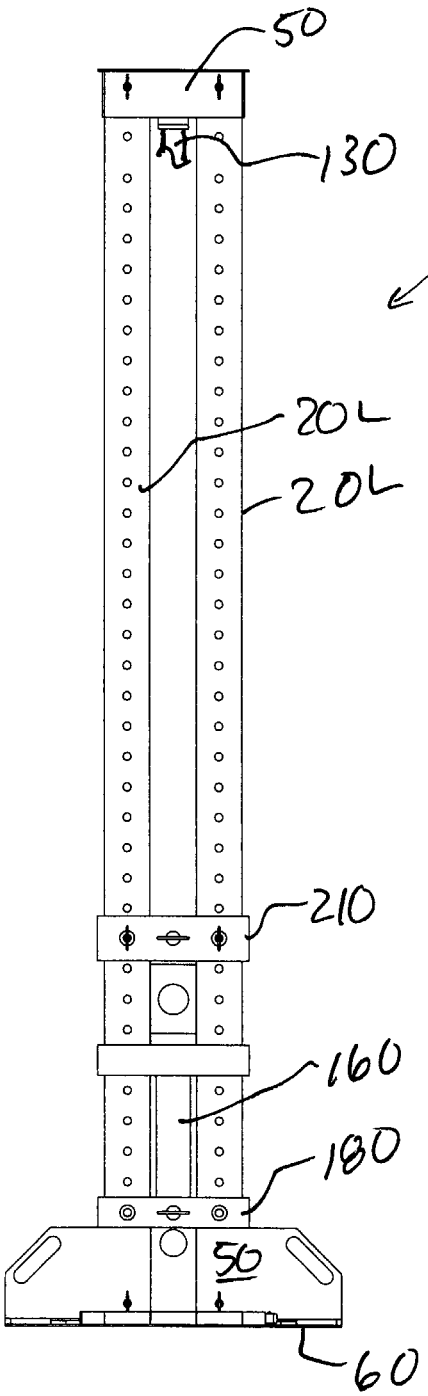
FIG. 10A is a front view of one embodiment of a double masted jack showing the use of long masts.
Figure 10B:
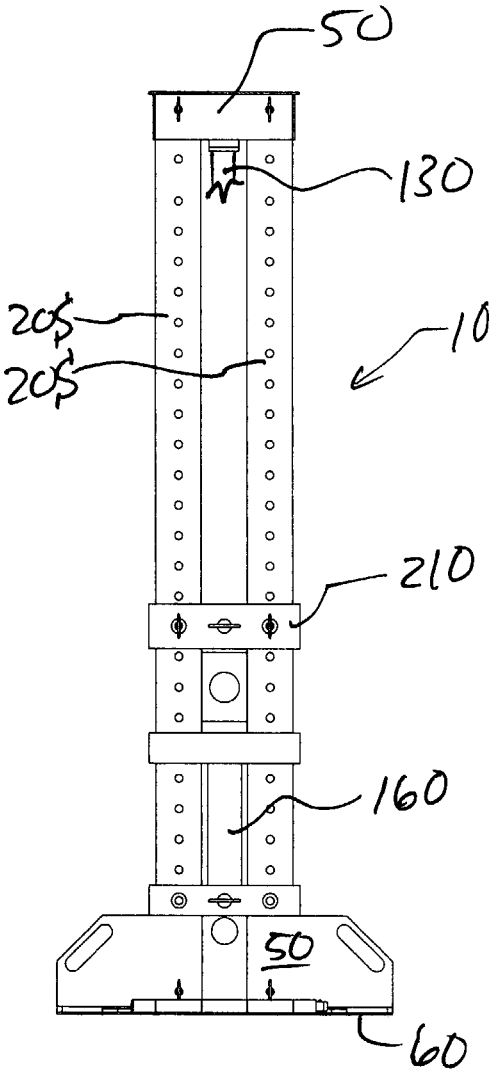
FIG. 10B is a front view of one embodiment of a double masted jack showing the use of short masts.
Figure 11A:
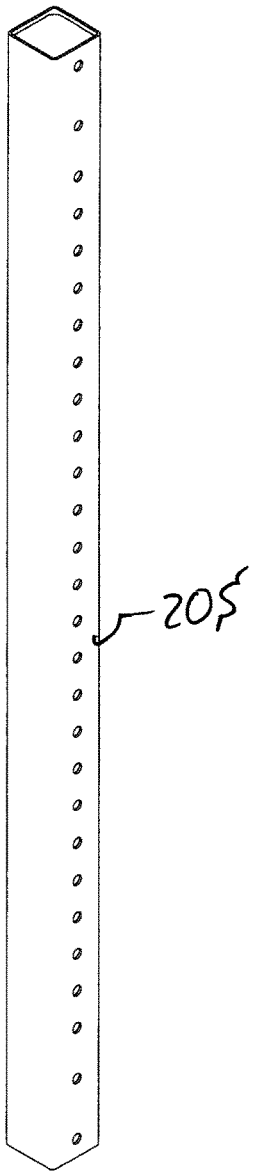
FIG. 11A is a perspective view of a short mast.
Figure 11B:
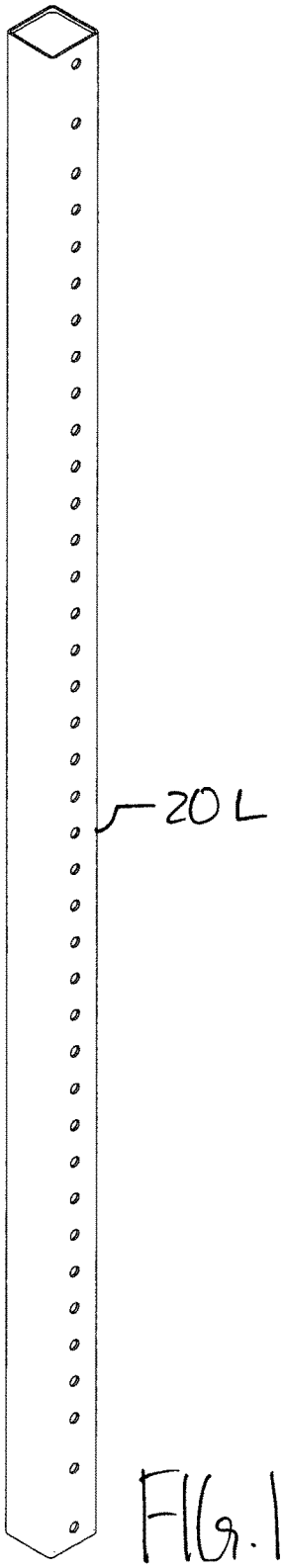
FIG. 11B is a perspective view of a long mast.

The operation of indexing bolt bracket 360 may be best understood by referring to FIG. 8B. As can be seen in FIG. 8B, vertical slot portion 360S2, has received both king pin 240 and base guide pin 50G. Recall that king pin 240 is fixed to shuttle 210 which, in turn is driven by hydraulic ram 160. Also recall that base guide pin 50G is fixed to base 50. In this example, base guide pin 50G is used to properly orient and locate indexing bolt bracket 360. The relative movement of king pin 240, base guide pin 50G and indexing bolt bracket may be best understood by referring to FIGS. 9A-9D. As can be seen in FIG. 9A, indexing bolt bracket 360 is fixed to a panel of a ring segment of a bin wall 5 preferably with fasteners common to a vertical seam between panels of the ring segment. The skilled reader should bear in mind that indexing bolt bracket 360 is only one of a set of such brackets attached to a plurality of vertical panel seams and that further kin pin 240 of shuttle 210 as well as base guide pin 50G are associated with a single jack which, in turn, is one of a corresponding set of jacks which are operated in unison. The initial positions for indexing bolt bracket 360, base guide pin 50G and king pin 240 are shown in FIG. 9B. These initial positions are typical of a condition prior to any lifting extension of hydraulic ram 160. FIG. 9C shows the relative positions of these elements after hydraulic ram 160 has begun lifting shuttle 210 and king pin 240. At this point bin wall 5 has lifted so that its bottom edge is no longer in frictional contact with foundation pad 6 (shown in FIGS. 1A-1C). Note that in FIG. 9B, king pin 240 is at the left most extent of slot portion 360S3. In FIG. 9C, because edge 360SE is inclined as shown in FIG. 18B, king pin 240 appears to have translated laterally across part of edge 360E. However, what has actually occurred is that king pin 240 has not moved laterally, rather, bin wall 5 and indexing bolt bracket 360 (which the skilled reader should recall is among a set of indexing bolt brackets) has rotated and translated downward slightly as king pin 240 moves along inclined edge 360SE. To facilitate this motion, King pin 240 may be provided with a low friction collar which is capable of rolling on edge 360E. In FIG. 9D, king pin 240. When king pin 240 reaches the right end of slot portion 360S3, it becomes possible for latch 360L to rotate down into the position shown in FIG. 9D. At this point, the lift will continue as king pin 240 is driven upward until hydraulic ram 240 has reached its maximum extension. When indexing bolt bracket 360 has reached the position shown in FIG. 9D, the panels of bin segment 5 are rotated to a new offset position suitable for attaching a next set of panels so that the vertical seams of the next set of panels are offset from the vertical seams of the previous set of panels.

Figure 22:
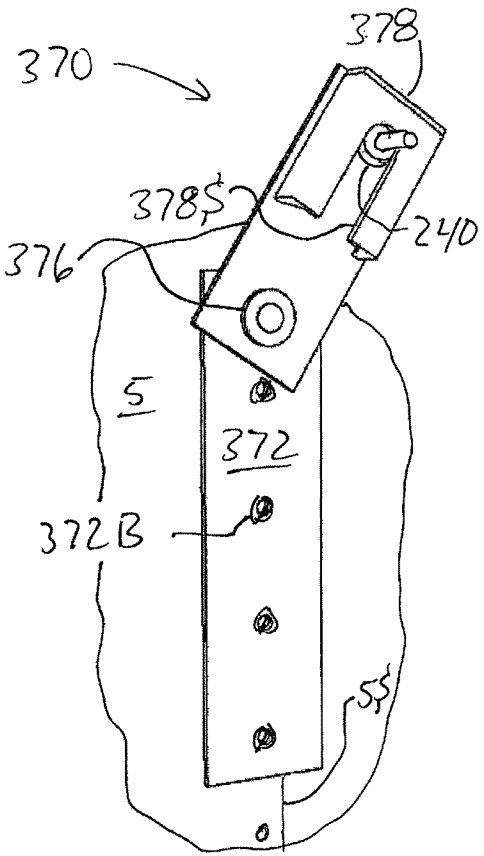
FIG. 22 is a front perspective view of the second embodiment of an indexing bolt bracket for use with a double masted jack shown showing the second embodiment bolt bracket in a non-lifted or non-raised or unaligned position.
Figure 21:
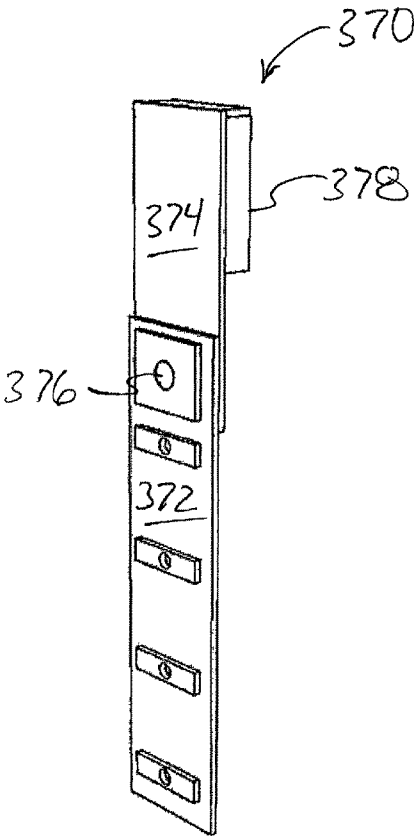
FIG. 21 is a rear perspective view of the second embodiment of an indexing bolt bracket for use with a double masted jack.
Figure 20:
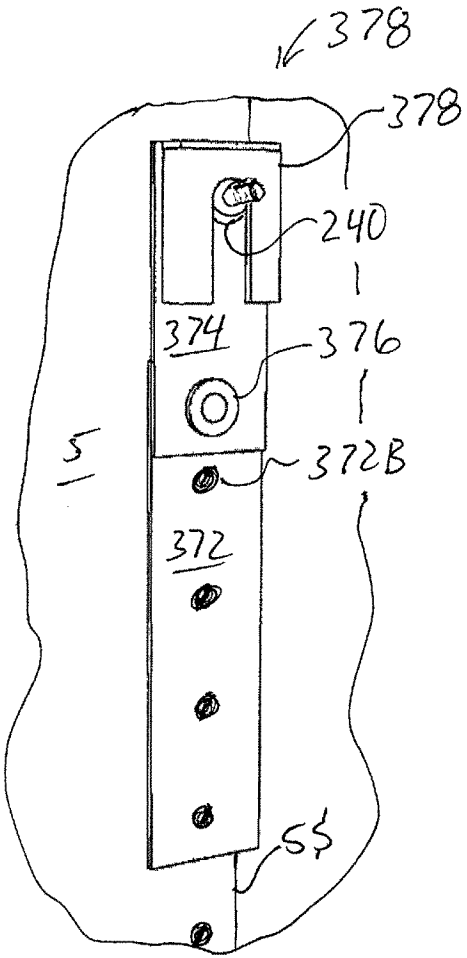
FIG. 20 is a front perspective view of a second embodiment of an indexing bolt bracket showing the second embodiment bolt bracket for use with a double masted jack shown in a lifted, raised or aligned position.

FIGS. 20-22 show a second embodiment indexing bolt bracket assembly 370 which may also be used for indexing the vertical seams between panels of a ring in a bin wall segment 5. (Bin wall segment 5, which is indicated in FIGS. 20 and 22 is part of a ring segment which includes a plurality of curved panels which are bolted together along vertical seams to define a ring segment which is only one of a plurality of stacked ring segments which make up the cylindrical wall of a bin or a tank.) As can be seen in FIGS. 20-21 bolt bracket assembly 370 includes a mounting plate 372 and a lift bracket 378. Mounting plate 372 is arranged to be temporarily fastened (bolted) to a panel of bin wall 5 by bolts 372B in a vertical fashion as shown in FIGS. 20 and 22. A lift bracket 378 is pivotably mounted to mounting plate 372 by a pivot joint 376. Lift bracket 378 presents a king pin slot 378S which is suitable for receiving king pin 240. Recall that king pin 240 is fixed to shuttle 210 which, in turn is lifted by hydraulic ram 160 as described above.

The operation of indexing bolt bracket 370 may be understood by referring to FIGS. 20 and 22. FIG. 22 shows bolt bracket 370 upon first receiving king pin 240 into king pin slot 378S. In practice, when a first ring of panels is to be lifted, and offset panel seams are desired, the panels and the jacks are arranged so that the jacks are offset from the seams (5S) of the panels. Shuttle 210 is placed in a starting position which places king pin 240 in a starting position as shown in FIG. 22. Lift bracket 378 is then slid onto king pin 240 as shown in FIG. 22 and mounting plate 378 is temporarily bolted to the offset row of panel seem fastener holes as is also shown in FIG. 22. At this point, bin wall 5 has not been lifted out of contact with foundation pad 6. As shuttle 210 and king pin 240 are raised as described above, bin wall 5 is sufficiently lifted so that its lower edge (not shown) loses contact with foundation pad 6 (not shown). When bin wall segment 5 has been lifted sufficiently from foundation pad 6, such that the lower edge of bin wall 5 no longer frictionally engages foundation pad 6, bin wall 5 rotates into the raised aligned position shown in FIG. 20. When bin wall 5 is further raised sufficiently, a new offset ring segment may be assembled under the raised ring segment. Once the raised ring segment is thus supported by an underlying ring segment, mounting plate 378 is unfastened from the seam in bin wall 5 and permanent fasteners are installed. With mounting plate 378 unfastened, lift bracket assembly 370 can be removed and slid away from king pin 240. Shuttle 210 and king pin 240 may also be lowered to their starting positions and the steps described immediately above may be repeated not only for one jack but for a plurality of jacks in order to construct a bin or tank of desired height which has ring panels with vertically offset seams.

Jacks 10 when in use, would be arranged in sets around the inside wall of a cylindrical structure being erected as shown in FIGS. 1A-1C. The shuttles of the jacks would be typically connected to a set of interconnected curved panels which form a ring of panels by using one of the types of bolt brackets 350 or 360 as described above, which, in turn, would be one portion of a cylindrical structure. Hydraulic rams 160 of jacks 10 would be connected to a common source of pressurized hydraulic fluid (not shown) which would be controlled by an operator to power hydraulic rams 160 of all of jacks 10 in the set to raise in unison in order to raise the ring of panels in a uniform manner. Operations would commence by (a) securing the lower lugs 162 of hydraulic rams 160 (shown in FIG. 3) to respective bottom brackets 180, (b) securing bottom brackets 180 to masts 20 on each side of each bottom bracket 180 and (c) securing upper lugs 164 (shown in FIG. 3) of each hydraulic ram to its prospective shuttle 210, (d) securing each shuttle 210 to each respective adjacent portion of the structure by placing a king pin 240 in the slot of a bolt bracket to be lifted, and finally (e) making sure that shuttles 210 are not secured to their respective masts 20 on each side of each shuttle 210. The hydraulic rams 160 are then supplied with pressurized hydraulic fluid to cause all of them to extend in unison. This action causes all of the shuttles to raise and the structure to be raised as well. Preferably, this occurs in a uniform manner so that the structure does not depart from its initial horizontal orientation. Once hydraulic rams 160 have reached the extended position, shuttles 210 are be pinned to their respective masts 20 and bottom brackets 180 are be unpinned from their respective masts 20. When in this configuration, the hydraulic rams are contracted to cause all bottom brackets 180 to be raised toward shuttles 210. If the operator pins bottom brackets 180 to masts 20 and unpins shuttles 210 from masts 20, the above described steps can be repeated until the panels are raised sufficiently above the surface of pad 6 to allow a next ring of panels to be installed. When a next ring of panels is installed, shuttles 210 may be disconnected from the first set of panels and connected to the next set of panels and the above described steps would be repeated until it would be possible to install yet another ring of panels. This process may even be executed in a reverse fashion to disassemble a cylindrical segmented structure.

Because bottom bracket 180 and the shuttle 210 may be pinned to a multitude of spaced holes in the masts, then bottom bracket 180 and the shuttle 210 may be arranged to accommodate a wide range of hydraulic rams 160 of varying stroke lengths. Accordingly, hydraulic rams having relatively long stroke lengths may be employed to rapidly lift structures which are relatively light weight. However, as the structure increases in height and weight, or if a very heavy structure is under construction, hydraulic rams having much greater load lifting capacity, but shorter stroke lengths could be selected. With such a high load configuration, more shuttle cycles will be required but the load may be safely and accurately lifted. It should be considered by the skilled reader that a set of hydraulic rams which are operating well below their load carrying capacities are more likely to extend in unison than hydraulic rams operating near the limits of their load lifting capacities. Uniform lifting is of paramount importance when building up a structure in this manner.

Figures 14A, 14B, 14C:
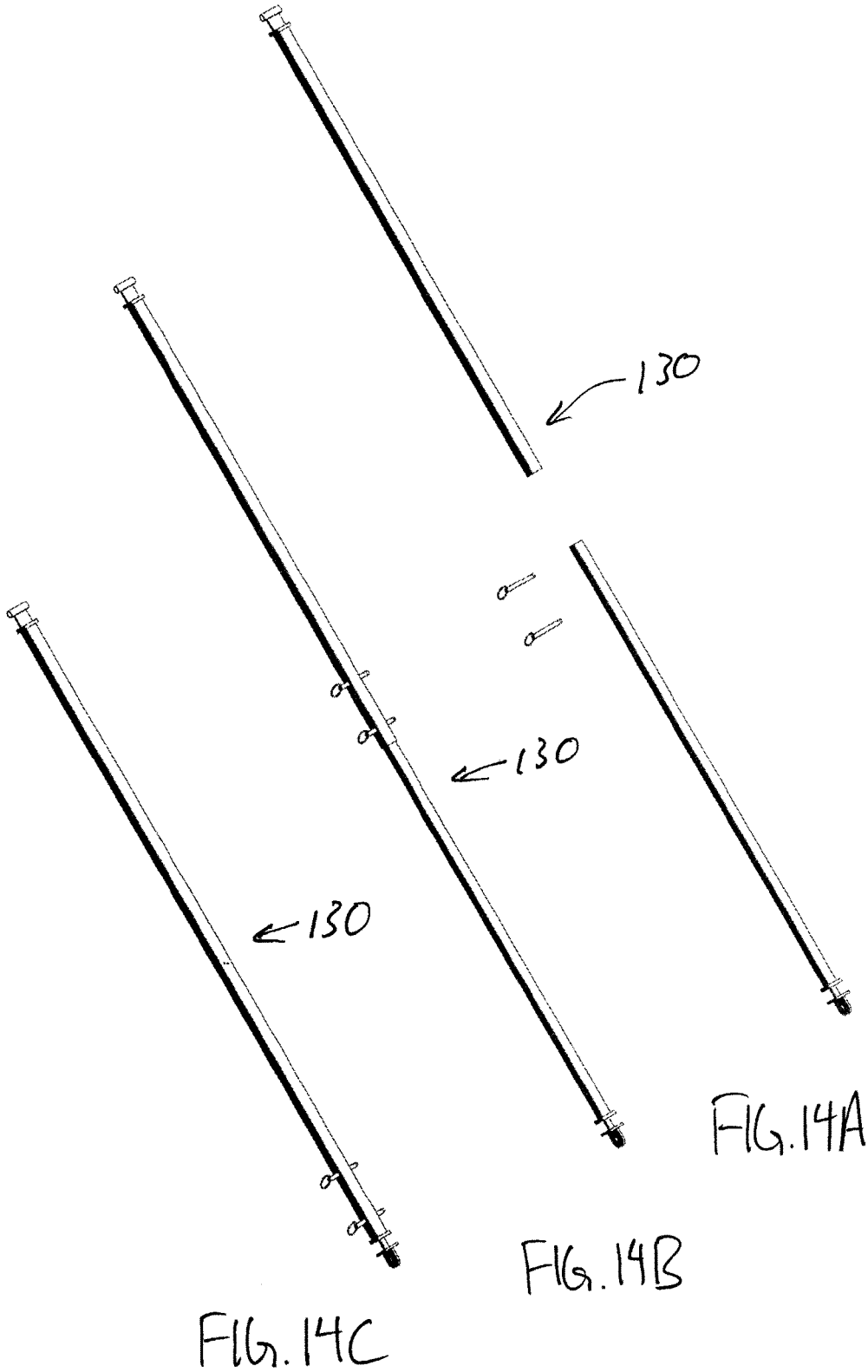
FIG. 14A is a perspective view of a back strut shown disassembled.
FIG. 14B is a perspective view of a back strut shown assembled for use with long masts.
FIG. 14C is a perspective view of a back strut shown assembled for use with short masts.
Figure 16C:
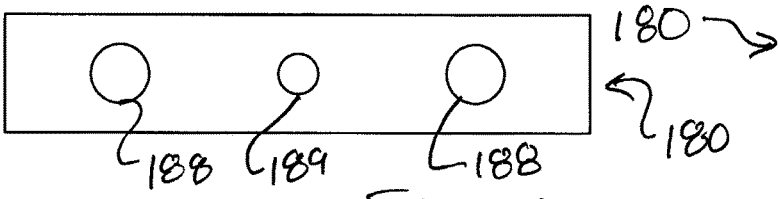
FIG. 16C is a front view of a bottom bracket.
Figure 16D:
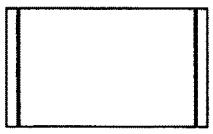
FIG. 16D is an end view of a bottom bracket.
Figure 16B:
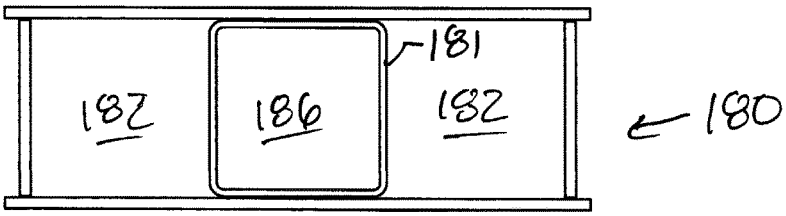
FIG. 16B is a top view of a bottom bracket.
Figure 16A:
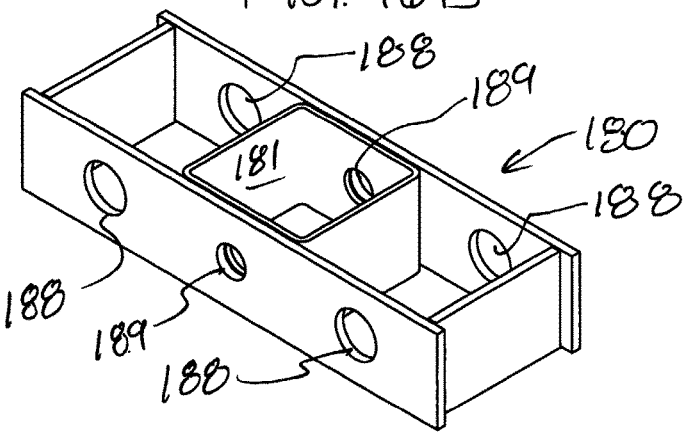
FIG. 16A is a perspective view of a bottom bracket.

Still further, back strut 130 which is fashioned as a telescoping back strut allows for the use of varying mast lengths as is illustrated in FIGS. 14A-14C. Taller masts might only require thicker walls to have sufficient structural strength. The designer need only select mast cross sections which have common outside envelope dimensions. Such masts would be interchangeably compatible with all of the components described above. Accordingly, above described jacks 10 are extremely versatile and may be reconfigured at will to safely accommodate a very wide range of construction needs.

It is to be understood that while certain forms of this invention have been illustrated and described, it is not limited thereto, except in so far as such limitations are included in the following claims and allowable equivalents thereof.

The invention claimed is:

1. A jack for raising a ring segment of a cylindrical structure on a foundation pad, comprising:

(a) a pair of masts, each mast extending from a lower end to an upper end, each mast presenting a plurality of evenly spaced holes, (b) a mast base operable for receiving the lower ends of the masts and securing the lower ends of the masts to the foundation pad in a side by side spaced apart relationship, (c) a mast cap operable for receiving the upper ends of the masts and securing the upper ends of the masts in a side by side, spaced apart relationship, (d) a hydraulic ram having a lower end and an upper end, the hydraulic ram operable for movement between a retracted position and an extended position, when in the extended position, the distance between the lower end and the upper end of the hydraulic ram being greater by a stroke distance than the distance between the lower and upper ends of the hydraulic ram when in the retracted, the stroke distance being substantially less than the length of the masts, (f) a bottom bracket which connects between the masts and which is adapted to be removably pinned to corresponding pairs of the evenly spaced holes of each mast, the bottom bracket operable to receive and support the lower end of the hydraulic ram such that the lower end of the hydraulic ram is positioned generally between the masts, the bottom bracket also operable for sliding vertically when the bottom bracket is not pinned to the masts, (g) a shuttle that connects between the masts and which is adapted to be removably pinned to holes in each mast, the shuttle operable to receive the upper end of the hydraulic ram such that the upper end of the hydraulic ram is positioned generally between the masts, the shuttle also operable for sliding vertically when the shuttle is not pinned to the masts, (h) the shuttle further presenting a king pin, (i) an indexing bolt bracket that is temporarily fastened to a ring segment of the structure, the indexing bolt bracket having a first portion that is able to be fastened to the ring segment and a second portion that is able to be pivotably attached to the first portion at a pivot joint, the second portion being arranged above the first portion, the second portion presenting a slot that is open at a first end and closed at a second end, the second portion being oriented, during operation, with the first end below the second end, and the slot suitable for receiving the king pin of the shuttle through the first end thereof, the second portion being able to be rotated so that king pin able may be laterally offset from the pivot joint, such that when the king pin is raised, the indexing bolt bracket is pulled upwardly until the ring segment is lifted off the foundation pad so that the ring segment is able to rotate until the upper and lower portions of the indexing bold bracket are vertically aligned, whereby when the bottom bracket is secured to the masts and the shuttle is not pinned to the masts, a segment of structure connected to the shuttle can be raised by extending the hydraulic ram from the retracted position toward the extended position, and whereby, when the raised shuttle is pinned to the masts and the bottom bracket is unpinned, the bottom bracket can be lifted toward the shuttle by contracting the hydraulic ram toward the retracted position, and whereby, after pinning the lifted bottom bracket to the masts and unpinning the shuttle, the shuttle and the segment of structure attached to the shuttle may be raised repeatedly extending the hydraulic ram toward the extended position, and whereby these steps may be repeated until the shuttle has reached the top of the masts.

2. A jack for raising a ring segment of a cylindrical structure on a foundation pad, comprising:

(a) a pair of generally identical upright masts, each mast extending from a lower end to an upper end, each mast presenting a plurality of evenly spaced holes, (b) a mast base operable for receiving the lower ends of the masts and securing the lower ends of the masts to the foundation pad in a side by side spaced apart relationship, (c) a mast cap operable for receiving the upper ends of the masts and securing the upper ends of the masts in a side by side, spaced apart relationship, (d) a hydraulic ram having a lower end and an upper end, the hydraulic ram operable for movement between a retracted position and an extended position, when in the extended position, the distance between the lower end and the upper end of the hydraulic ram being greater by a stroke distance than the distance between the lower and upper ends of the hydraulic ram when in the retracted, the stroke distance being substantially less than the length of the masts, (e) a back strut operable for connecting between the mast cap and a support location which is spaced away from the mast base, (f) a bottom bracket which connects between the masts and which is adapted to be removably pinned to corresponding pairs of the evenly spaced holes of each mast, the bottom bracket operable to receive and support the lower end of the hydraulic ram such that the lower end of the hydraulic ram is positioned generally between the masts, the bottom bracket also operable for sliding vertically when the bottom bracket is not pinned to the masts, (g) a shuttle which connects between the masts and which is adapted to be removably pinned to corresponding pairs of the evenly spaced holes of each mast, the shuttle operable to receive the upper end of the hydraulic ram such that the upper end of the hydraulic ram is positioned generally between the masts, the shuttle also operable for sliding vertically when the shuttle is not pinned to the masts, the shuttle presenting a king pin, (h) an indexing bolt bracket that is temporarily fastened to a ring segment of the structure, the indexing bolt bracket having a first portion that is able to be fastened to the ring segment and a second portion that is able to be pivotably attached to the first portion at a pivot joint, the second portion being arranged above the first portion, the second portion presenting a slot that is open at a first end and closed at a second end, the second portion being oriented, during operation, with the first end below the second end, and the slot suitable for receiving the king pin of the shuttle through the first end thereof, the second portion being able to be rotated so that the king pin is laterally offset away from the pivot joint such that when the king pin is raised, the indexing bolt bracket is pulled upwardly until the ring segment is lifted off the foundation pad so that the ring segment is able to rotate until the upper portion of the indexing bolt bracket and the lower portion of the indexing bolt bracket are vertically aligned with each other, whereby, when the bottom bracket is secured to the masts and the shuttle is not pinned to the masts, a ring segment of structure connected to the shuttle can be raised by extending the hydraulic ram from the retracted position toward the extended position, and whereby, when the raised shuttle is pinned to the masts and the bottom bracket is unpinned, the bottom bracket can be lifted toward the shuttle by contracting the hydraulic ram toward the retracted position, and whereby, after pinning the lifted bottom bracket to the masts and unpinning the shuttle, the shuttle and the segment of structure attached to the shuttle may be raised again by again extending the hydraulic ram toward the extended position, and whereby these steps may be repeated until the shuttle has reached the top of the masts.

3. The jack of claim 2, wherein:

the mast base and the masts present corresponding holes and are arranged to be assembled using the corresponding holes in the masts and the mast base and removable pins adapted to be received by the corresponding holes.

4. The jack of claim 2, wherein:

the mast cap and the masts present corresponding holes and are arranged to be assembled using the corresponding holes in the masts and the mast base and removable pins adapted to be received by the corresponding holes.

5. The jack of claim 2, wherein:

the mast cap and the masts present corresponding holes and the mast base and the masts present corresponding holes, the mast cap, the mast base and the masts are arranged to be assembled using the corresponding holes in the masts, the mast base and the mast cap and removable pins adapted to be received by the corresponding holes.

6. The jack of claim 2, wherein:

the mast base further includes a pivoting bottom plate which can be secured to a structure foundation, the mast base being pivotable between a first horizontal assembly position and a second upright operating position, the pivot plate and the mast base having a base plate locking device for securing the mast base in the second upright operating position, whereby the jack may be assembled in the horizontal assembly position, rotated up to the upright operating position and secured by engaging the base plate locking device.

7. The jack of claim 2, wherein:

the mast base further includes a mast base plate which is suitable for securing to the foundation pad at a worksite, the mast base plate being pivotably connected to the mast base and arranged such that the mast base is able to be tilted into a horizontal position suitable for receiving the masts in a horizontal position, the mast base plate and the mast base further having corresponding features suitable for interlocking the mast base to the mast base plate so that the mast base and masts are able to be secured in the upright position.

* * * * *